US011530473B2

(12) United States Patent
Florey et al.

(10) Patent No.: US 11,530,473 B2
(45) Date of Patent: Dec. 20, 2022

(54) HIGH STRENGTH AND HIGHLY FORMABLE ALUMINUM ALLOYS RESISTANT TO NATURAL AGE HARDENING AND METHODS OF MAKING THE SAME

(71) Applicant: Novelis Inc., Atlanta, GA (US)

(72) Inventors: Guillaume Florey, Valais (CH); Corrado Bassi, Valais (CH); Aude Despois, Valais (CH); David Leyvraz, Sierre (CH)

(73) Assignee: Novelis Inc., Atlanta, GA (US)

( * ) Notice: Subject to any disclaimer, the term of this patent is extended or adjusted under 35 U.S.C. 154(b) by 270 days.

(21) Appl. No.: 15/838,651

(22) Filed: Dec. 12, 2017

(65) Prior Publication Data

US 2018/0171452 A1 Jun. 21, 2018

Related U.S. Application Data

(60) Provisional application No. 62/477,677, filed on Mar. 28, 2017, provisional application No. 62/435,382, filed on Dec. 16, 2016.

(51) Int. Cl.

| | |
|---|---|
| ***C22F 1/05*** | (2006.01) |
| ***C22C 21/04*** | (2006.01) |
| ***C22C 21/08*** | (2006.01) |
| ***C22F 1/00*** | (2006.01) |
| *C22F 1/04* | (2006.01) |

(52) U.S. Cl.

CPC ..... *C22F 1/05* (2013.01); *C22C 21/04* (2013.01); *C22C 21/08* (2013.01); *C22F 1/002* (2013.01)

(58) Field of Classification Search

CPC ..... C22C 21/12–18; C22F 1/06

See application file for complete search history.

(56) References Cited

U.S. PATENT DOCUMENTS 4,174,232 A 11/1979 Lenz et al.
5,616,189 A * 4/1997 Jin ..... C22C 21/08 148/549

(Continued)

FOREIGN PATENT DOCUMENTS

CN 1158148 8/1997
CN 101509114 8/2009

(Continued)

OTHER PUBLICATIONS

Guo et al. "Enhanced bake-hardening response of an Al—Mg—Si—Cu alloy with Zn addition", Materials Chemistry and Physics, vol. 162, 2015, p. 15-19 (Year: 2015).*

(Continued)

*Primary Examiner* — Lois L Zheng

(74) *Attorney, Agent, or Firm* — Kilpatrick Townsend & Stockton LLP

(57) ABSTRACT

Disclosed are high-strength, highly deformable aluminum alloys and methods of making and processing such alloys. More particularly, disclosed is a heat treatable aluminum alloy exhibiting improved mechanical strength and formability. The processing method includes casting, homogenizing, hot rolling, solutionizing, pre-aging and in some cases pre-straining. In some cases, the processing steps can further include cold rolling and/or heat treating.

15 Claims, 36 Drawing Sheets

(56) References Cited

U.S. PATENT DOCUMENTS

| | | | | |
|---|---|---|---|---|
| 6,120,623 | A * | 9/2000 | Gupta | C22C 21/08 148/552 |
| 7,824,607 | B2 | 11/2010 | Kajihara et al. | |
| 10,533,243 | B2 | 1/2020 | Newman et al. | |
| 10,550,455 | B2 | 2/2020 | Hosch et al. | |
| 2003/0015261 | A1 | 1/2003 | Bull et al. | |
| 2005/0028894 | A1 | 2/2005 | Hoffmann et al. | |
| 2005/0288894 | A1 | 12/2005 | Vorenkamp et al. | |
| 2015/0354044 | A1 | 12/2015 | Shishido et al. | |
| 2016/0201158 | A1 | 7/2016 | Kamat et al. | |
| 2017/0009325 | A1 | 1/2017 | Wyatt-Mair et al. | |
| 2017/0175240 | A1* | 6/2017 | Wen | C22F 1/05 |

FOREIGN PATENT DOCUMENTS

| | | |
|---|---|---|
| CN | 101550509 | 10/2009 |
| CN | 101684531 | 3/2010 |
| CN | 101880801 | 11/2010 |
| CN | 102373353 | 3/2012 |
| CN | 102732760 | 10/2012 |
| CN | 103060632 | 4/2013 |
| CN | 103255324 | 8/2013 |
| CN | 103320728 | 9/2013 |
| CN | 103981404 | 8/2014 |
| CN | 104114726 | 10/2014 |
| CN | 103781625 | 5/2016 |
| CN | 107475584 | 12/2017 |
| EP | 2987879 | 2/2016 |
| EP | 3555333 | 1/2021 |
| JP | H05302154 | 11/1993 |
| JP | H09268356 | 10/1997 |
| JP | 2004211177 | 7/2004 |
| JP | 2007523262 | 8/2007 |
| JP | 2009007617 | 1/2009 |
| JP | 2009041045 | 2/2009 |
| JP | 2010116594 | 5/2010 |
| JP | 2013023747 | 2/2013 |
| JP | 2014143299 | 8/2014 |
| JP | 2016020530 | 2/2016 |
| JP | 2016141842 | 8/2016 |
| RU | 2163940 | 3/2001 |
| RU | 2221891 | 1/2004 |
| WO | 9603531 | 2/1996 |
| WO | 02090608 | 11/2002 |
| WO | 02090609 | 11/2002 |
| WO | 2014046010 | 3/2014 |
| WO | 2016190408 | 12/2016 |

OTHER PUBLICATIONS

"International Alloy Designations and Chemical Composition Limits for Wrought Aluminum and Wrought Aluminum Alloys", The Alumininum Association, Inc., Registration Record Series: Teal Sheets, Feb. 1, 2009, 35 pages.
Australian Application No. 2017378132 , "First Examination Report", dated Sep. 20, 2019, 3 pages.
Guo et al., "Enhanced Bake-Hardening Response of an Al—Mg—Sicu Alloy with Zn Addition", Materials Chemistry and Physics, vol. 162, Jul. 15, 2015, pp. 15-19.
International Application No. PCT/US2017/065715 , "International Preliminary Report on Patentability", dated Jun. 27, 2019, 8 pages.
International Application No. PCT/US2017/065715 , "International Search Report and Written Opinion", dated Feb. 16, 2018, 12 pages.
Shen , "Pre-Treatment to Improve the Bake-Hardening Response in the Naturally Aged Al—Mg—Si Alloy", Journal of Materials Science & Technology, vol. 27, No. 3, Jan. 1, 2011, pp. 205-212.
Russian Application No. 2019119527 , "Office Action", dated Feb. 6, 2020, 12 pages.
European Application No. EP17830056.2, Office Action, dated Jul. 1, 2020, 5 pages.
Japanese Application No. 2019-531248, Office Action, dated Jul. 28, 2020, 23 pages.
Canadian Application No. 3,046,364 , Office Action, dated Sep. 1, 2020, 6 pages.
Chinese Application No. 201780077508.3, Office Action, dated Sep. 2, 2020, 15 pages.
Australian Application No. AU2017378132, Notice of Acceptance dated Jan. 20, 2020, 3 pages.
Indian Application No. 201917023415, "First Examination Report", dated Feb. 5, 2021, 7 pages.
Canadian Application No. 3,046,364, Office Action, dated May 27, 2021, 3 pages.
Korean Application No. 10-2019-7020518, Office Action, dated May 12, 2021, 7 pages.
Korean Application No. KR10-2019-7020518, Notice of Decision to Grant, dated Jun. 21, 2021, 2 pages.
Canadian Application No. 3,046,364 , Office Action, dated Dec. 2, 2020, 2 pages.
Japanese Application No. 2019-531248 , Submission of Third Party Observations, dated Dec. 1, 2020, 2 pages.
Japanese Application No. 2019-531248 , Office Action, dated Jan. 12, 2021, 5 pages.
Korean Application No. 10-2019-7020518 , Office Action, dated Nov. 20, 2020, 14 pages.
Brazilian Application No. 112019011314-2, Office Action, dated Aug. 10, 2021, 5 pages.
Chinese Application No. 201780077508.3, Office Action, dated Jun. 2, 2021, 15 pages.
Japanese Application No. 2019-531248, Office Action, dated Jul. 6, 2021, 4 pages.
Chinese Application No. 201780077508.3, Office Action, dated Mar. 10, 2021, 20 pages.
European Application No. 17830056.2, Office Action, dated Apr. 15, 2021, 4 pages.
Zhuang et al., "Improvement in Bake Hardening Response of Al—Si—Mg Alloys", Materials Science Forum, vols. 331-337, May 2000, pp. 1309-1314.
Canadian Application No. 3,046,364, Notice of Allowance, dated Dec. 14, 2021, 1 page.
European Application No. 17830056.2 , Notice of Decision to Grant, dated Jan. 7, 2022, 2 pages.
Japanese Application No. 2019-531248 , Notice of Decision to Grant, dated Feb. 1, 2022, 6 pages.
Mexican Application No. MX/A/2019/006952 , Office Action, dated May 13, 2022, 3 pages.
Brazilian Application No. BR112019011314-2, "Office Action", dated Aug. 9, 2022, 6 pages.
Mexican Application No. MX/A/2019/006952, "Notice of Allowance", dated Sep. 9, 2022, 2 pages.

* cited by examiner

HIGH STRENGTH AND HIGHLY FORMABLE ALUMINUM ALLOYS RESISTANT TO NATURAL AGE HARDENING AND METHODS OF MAKING THE SAME

CROSS-REFERENCE TO RELATED APPLICATIONS

This application claims the benefit of U.S. Provisional Application Nos. 62/435,382, filed Dec. 16, 2016, and 62/477,677, filed Mar. 28, 2017, which are incorporated herein by reference in their entireties.

FIELD

This disclosure relates to high-strength aluminum alloys and methods of making and processing the same. The disclosure further relates to heat treatable aluminum alloys exhibiting improved mechanical strength and formability.

BACKGROUND

Recyclable aluminum alloys with high strength are desirable for improved product performance in many applications, including transportation (encompassing without limitation, e.g., trucks, trailers, trains, and marine) applications, electronics applications, automobile applications and others. For example, a high-strength aluminum alloy in trucks or trailers would be lighter than conventional steel alloys, which may provide significant emission reductions that are needed to meet new, stricter government regulations on emissions. Such alloys should exhibit high strength, high formability, and corrosion resistance.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

Provided herein are methods of preparing 6xxx series aluminum alloys, the aluminum alloys, and products comprising the disclosed alloys.

One aspect relates to methods of processing aluminum. For example, disclosed herein are methods of producing an aluminum alloy product, the method comprising casting an aluminum alloy to form a cast aluminum alloy product, wherein the aluminum alloy comprises about 0.05-1.1 wt. % Cu, about 0.6-1.1 wt. % Si, about 0.7-1.2 wt. % Mg, up to about 0.25 wt. % Cr, up to about 0.35 wt. % Mn, up to about 0.4 wt. % Fe, up to about 0.25 wt. % Zr, up to about 1.0 wt. % Zn, up to about 0.10 wt. % Ti, up to about 0.04 wt. % Ni, and up to about 0.15 wt. % of impurities, with the remainder as Al; homogenizing the cast aluminum alloy product; hot rolling the cast aluminum alloy product to produce a rolled product (e.g., a sheet, plate, or shate); solutionizing the sheet, plate, or shate at a temperature between about 520° C. and about 580° C.; pre-aging the sheet, plate, or shate; and coiling the aluminum alloy sheet, plate, or shate. Throughout this application, all elements are described in weight percentage (wt. %) based on the total weight of the alloy.

In some examples, the aluminum alloy can include about 0.6-1.1 wt. % Cu, about 0.6-1.1 wt. % Si, about 0.7-1.2 wt. % Mg, up to about 0.25 wt. % Cr, up to about 0.35 wt. % Mn, about 0.05-0.4 wt. % Fe, up to about 0.25 wt. % Zr, up to about 0.3 wt. % Zn, up to about 0.10 wt. % Ti, up to about 0.04 wt. % Ni, and up to about 0.15 wt. % of impurities, with the remainder as Al. In some cases, the aluminum alloy can include about 0.7-1.0 wt. % Cu, about 0.65-1.0 wt. % Si, about 0.8-1.1 wt. % Mg, about 0.01-0.20 wt. % Cr, up to about 0.25 wt. % Mn, about 0.10-0.35 wt. % Fe, up to about 0.2 wt. % Zr, up to about 0.2 wt. % Zn, about 0.01-0.05 wt. % Ti, up to about 0.035 wt. % Ni, and up to about 0.15 wt. % of impurities, with the remainder as Al. In some cases, the aluminum alloy can include about 0.75-0.9 wt. % Cu, about 0.65-0.9 wt. % Si, about 0.85-1.0 wt. % Mg, about 0.05-0.18 wt. % Cr, about 0.05-0.18 wt. % Mn, about 0.12-0.30 wt. % Fe, up to about 0.15 wt. % Zr, up to about 0.1 wt. % Zn, about 0.01-0.04 wt. % Ti, up to about 0.034 wt. % Ni, and up to about 0.15 wt. % of impurities, with the remainder as Al.

The pre-aging the sheet, plate, or shate step can comprise heating the sheet, plate, or shate to a temperature of about 115° C. to about 135° C., or in some cases between about 120° C. to about 130° C., after solutionizing. In some aspects, the pre-aging step after the solutionizing step can provide an aluminum alloy in a pre-aged condition resulting in an exemplary temper that can exhibit improved resistance to natural aging of the alloy and/or improved uniform formability. In some cases, a pre-aged alloy resistant to natural age-hardening can exhibit an increased shelf life for storing as-produced aluminum alloys.

The methods described herein can further comprise strain hardening and/or thermal treating the aluminum alloy product. The strain hardening can optionally be performed at about 2% and the thermal treating can comprise maintaining the aluminum alloy product at a temperature of about 185° C. for a time period of about 20 minutes.

The methods described herein can further comprise quenching the aluminum alloy product after the solutionizing step; cold rolling the aluminum alloy product; aging the aluminum alloy product (e.g., by heating the aluminum alloy product between about 180° C. to about 225° C. for a period of time); and/or pre-straining the aluminum metal product, wherein the pre-straining comprises applying a tensile strain to the aluminum alloy product after solutionizing.

Optionally, the aluminum alloy product comprises a strain hardening exponent of at least 0.23. Optionally, the aluminum alloy product comprises a strength of at least 300 MPa after a 2% pre-strain hardening and thermal treatment of about 185° C. for a time period of about 20 minutes. In some non-limiting examples, the aluminum alloy product comprises a strength of at least 300 MPa.

Also disclosed are aluminum alloy products (e.g., transportation body parts, such as automotive body parts or structural body parts, and electronics device housings) comprising an alloy obtained according to the methods provided herein.

Further aspects, objects, and advantages will become apparent upon consideration of the detailed description of non-limiting examples and figures that follow.

DETAILED DESCRIPTION

Figure 1:
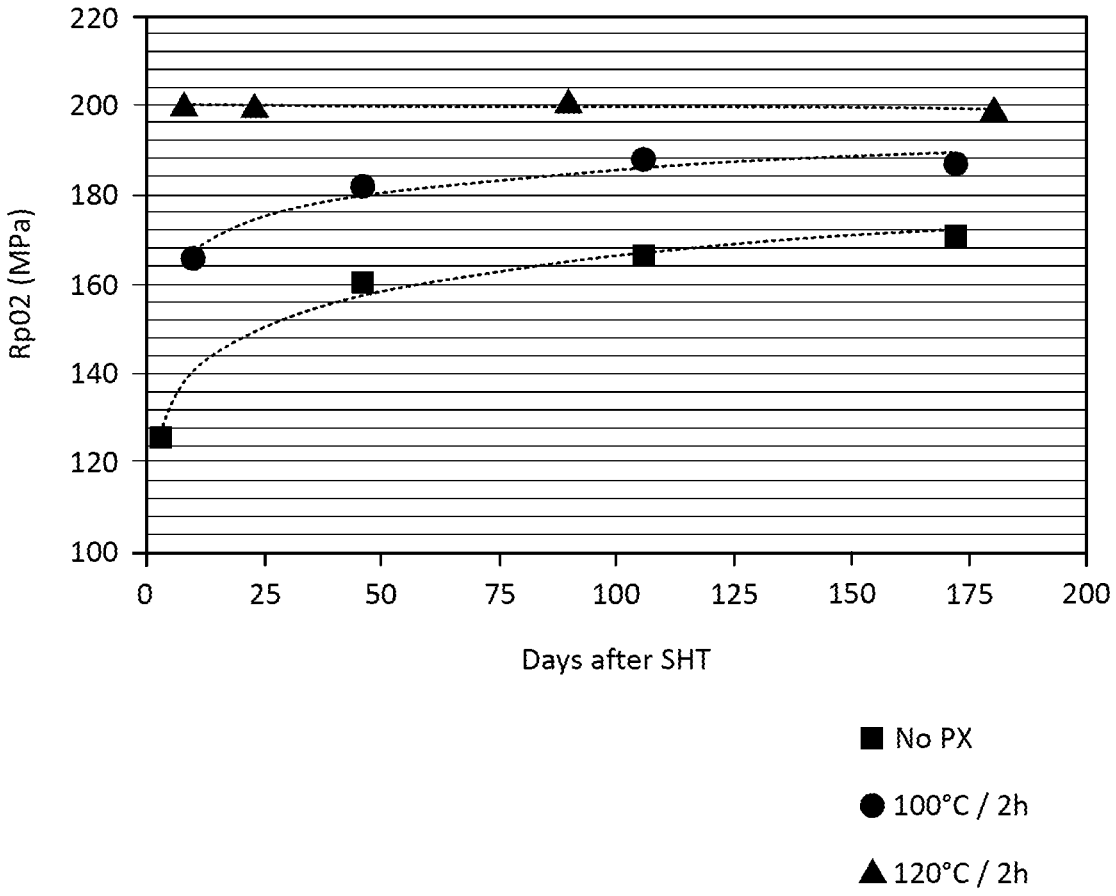
FIG. 1 is a graph showing a comparison between the tensile properties over time of an exemplary alloy exposed to various pre-aging conditions after solutionizing.

Described herein are heat treatable aluminum alloys and methods of making and processing the same. The heat treatable aluminum alloys exhibit improved mechanical strength and deformability properties, including formability and bendability. The alloys can be processed in a method such that the resulting metal products have high strength and high deformability properties. The properties of the metal products can be further enhanced during downstream processing (e.g., end user forming and post-forming heat treating the metal product, or end user paint baking). Surprisingly, due to the conditions used during the processing methods as further described herein, the metal products can achieve an increased final strength without degrading the final bendability or elongation.

Definitions and Descriptions

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by aluminum industry designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," or "the" includes singular and plural references unless the context clearly dictates otherwise.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

As used herein, a "plate" generally has a thickness of greater than about 15 mm. For example, a plate may refer to an aluminum product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a "shate" (also referred to as a sheet plate) generally refers to an aluminum product having a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a "sheet" generally refers to an aluminum product having a thickness of less than about 4 mm. For example, a sheet may have a thickness of less than about 4 mm, less than about 3 mm, less than about 2 mm, less than about 1 mm, less than about 0.5 mm, less than about 0.3 mm, or less than about 0.1 mm.

As used herein, terms such as "cast aluminum alloy product," "cast product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method. All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T3 condition or temper refers to an aluminum alloy solution heat treated (i.e., solutionized), cold worked, and naturally aged. A T4 condition or temper refers to an aluminum alloy solution heat treated and naturally aged. A T6 condition or temper refers to an aluminum alloy solution heat treated and artificially aged. A T8x condition or temper refers to an aluminum alloy solution heat treated, cold worked, and artificially aged.

The following aluminum alloys are described in terms of their elemental composition in weight percentage (wt. %) based on the total weight of the alloy. In certain examples of each alloy, the remainder is aluminum, with a maximum wt. % of 0.15% for the sum of the impurities.

Alloy Composition

Described herein are novel aluminum alloys that can exhibit high strength and high formability. In some cases, the aluminum alloys include heat treatable aluminum alloys. As used herein, heat treatable aluminum alloys include 2xxx series alloys, 6xxx series alloys, and 7xxx series alloys. In certain aspects, the alloys exhibit high strength and high deformability. In some cases, the alloys exhibit an increase in strength after thermal treatment without significant loss of deformability. The properties of the alloys are achieved at least in part due to the methods of processing the alloys to produce the described plates, shates, sheets or other products.

In some examples, the alloys can have the following elemental composition as provided in Table 1.

TABLE 1

| Element | Weight Percentage (wt. %) |
|---|---|
| Cu | 0.05-1.1 |
| Si | 0.6-1.1 |
| Mg | 0.7-1.2 |
| Cr | 0.0-0.25 |
| Mn | 0.0-0.35 |
| Fe | 0.0-0.4 |
| Zr | 0.0-0.25 |
| Zn | 0.0-1.0 |
| Ti | 0.0-0.3 |
| Ni | 0.0-0.04 |
| Impurities | 0.0-0.05 (each)<br>0.0-0.15 (total) |
| Al | Remainder |

In some examples, the alloys can have the following elemental composition as provided in Table 2.

TABLE 2

| Element | Weight Percentage (wt. %) |
|---|---|
| Cu | 0.6-1.1 |
| Si | 0.6-1.1 |
| Mg | 0.7-1.2 |
| Cr | 0.0-0.25 |
| Mn | 0.0-0.35 |
| Fe | 0.05-0.4 |
| Zr | 0.0-0.25 |
| Zn | 0.0-0.3 |

TABLE 2-continued

| Element | Weight Percentage (wt. %) |
|---|---|
| Ti | 0.0-0.10 |
| Ni | 0.0-0.04 |
| Impurities | 0.0-0.05 (each)<br>0.0-0.15 (total) |
| Al | Remainder |

In other examples, the alloys can have the following elemental composition as provided in Table 3.

TABLE 3

| Element | Weight Percentage (wt. %) |
|---|---|
| Cu | 0.7-1.0 |
| Si | 0.65-1.0 |
| Mg | 0.8-1.1 |
| Cr | 0.01-0.20 |
| Mn | 0.0-0.25 |
| Fe | 0.10-0.35 |
| Zr | 0.0-0.2 |
| Zn | 0.0-0.2 |
| Ti | 0.01-0.07 |
| Ni | 0.0-0.034 |
| Impurities | 0.0-0.05 (each)<br>0.0-0.15 (total) |
| Al | Remainder |

In one example, an aluminum alloy can have the following elemental composition as provided in Table 4. In certain aspects, the alloy is used to prepare aluminum plates and shates.

TABLE 4

| Element | Weight Percentage (wt. %) |
|---|---|
| Cu | 0.75-0.9 |
| Si | 0.65-0.9 |
| Mg | 0.85-1.0 |
| Cr | 0.05-0.18 |
| Mn | 0.05-0.18 |
| Fe | 0.12-0.30 |
| Zr | 0.0-0.15 |
| Zn | 0-0.15 |
| Ti | 0.012-0.05 |
| Ni | 0.0-0.034 |
| Impurities | 0.0-0.05 (each)<br>0.0-0.15 (total) |
| Al | Remainder |

In certain examples, the disclosed alloy includes copper (Cu) in an amount from about 0.05% to about 1.1% (e.g., from about 0.6% to about 1.1%, from about 0.65% to about 0.9%, from about 0.7% to about 1.0%, or from about 0.6% to about 0.7%) based on the total weight of the alloy. For example, the alloys can include about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, about 0.25%, about 0.26%, about 0.27%, about 0.28%, about 0.29%, about 0.3%, about 0.31%, about 0.32%, about 0.33%, about 0.34%, about 0.35%, about 0.36%, about 0.37%, about 0.38%, about 0.39%, about 0.4%, about 0.41%, about 0.42%, about 0.43%, about 0.44%, about 0.45%, about 0.46%, about 0.47%, about 0.48%, about 0.49%, about 0.5%, about 0.51%, about 0.52%, about 0.53%, about 0.54%, about 0.55%, about 0.56%, about 0.57%, about 0.58%, about 0.59%, about 0.6%, about 0.61%, about 0.62%, about 0.63%, about 0.64%, about 0.65%, about 0.66%, about 0.67%, about 0.68%, about 0.69%, about 0.7%, about 0.71%, about 0.72%, about 0.73%, about 0.74%, about 0.75%, about 0.76%, about 0.77%, about 0.78%, about 0.79%, about 0.8%, about 0.81%, about 0.82%, about 0.83%, about 0.84%, about 0.85%, about 0.86%, about 0.87%, about 0.88%, about 0.89%, about 0.9%, about 0.91%, about 0.92%, about 0.93%, about 0.94%, about 0.95%, about 0.96%, about 0.97%, about 0.98%, about 0.99%, about 1.0%, about 1.01%, about 1.02%, about 1.03%, about 1.04%, about 1.05%, about 1.06%, about 1.07%, about 1.08%, about 1.09%, about or about 1.1% Cu. All expressed in wt. %.

In certain examples, the disclosed alloy includes silicon (Si) in an amount from about 0.6% to about 1.1% (e.g., from about 0.65% to about 1.0%, from about 0.9% to about 1.1%, from about 0.65% to about 0.9%, from about 0.9% to about 1.1%, or from about 1.0% to about 1.1%) based on the total weight of the alloy. For example, the alloys can include about 0.6%, about 0.61%, about 0.62%, about 0.63%, about 0.64%, about 0.65%, about 0.66%, about 0.67%, about 0.68%, about 0.69%, about 0.7%, about 0.71%, about 0.72%, about 0.73%, about 0.74%, about 0.75%, about 0.76%, about 0.77%, about 0.78%, about 0.79%, about 0.8%, about 0.81%, about 0.82%, about 0.83%, about 0.84%, about 0.85%, about 0.86%, about 0.87%, about 0.88%, about 0.89%, about 0.9%, about 0.91%, about 0.92%, about 0.93%, about 0.94%, about 0.95%, about 0.96%, about 0.97%, about 0.98%, about 0.99%, about 1.0%, about 1.01%, about 1.02%, about 1.03%, about 1.04%, about 1.05%, about 1.06%, about 1.07%, about 1.08%, about 1.09%, or about 1.1% Si. All expressed in wt. %.

In certain examples, the disclosed alloy includes magnesium (Mg) in an amount from about 0.7% to about 1.2% (e.g., from about 1.0% to about 1.25%, from about 1.1% to about 1.25%, from about 1.1% to about 1.2%, from about 1.0% to about 1.2%, from about 1.05% to about 1.3%, or from about 1.15% to about 1.3%) based on the total weight of the alloy. For example, the alloys can include about 0.7%, about 0.71%, about 0.72%, about 0.73%, about 0.74%, about 0.75%, about 0.76%, about 0.77%, about 0.78%, about 0.79%, about 0.8%, about 0.81%, about 0.82%, about 0.83%, about 0.84%, about 0.85%, about 0.86%, about 0.87%, about 0.88%, about 0.89%, about 0.9%, about 0.91%, about 0.92%, about 0.93%, about 0.94%, about 0.95%, about 0.96%, about 0.97%, about 0.98%, about 0.99%, about 1.0%, about 1.01%, about 1.02%, about 1.03%, about 1.04%, about 1.05%, about 1.06%, about 1.07%, about 1.08%, about 1.09%, about 1.1%, about 1.11%, about 1.12%, about 1.13%, about 1.14%, about 1.15%, about 1.16%, about 1.17%, about 1.18%, about 1.19%, or about 1.2% Mg. All expressed in wt. %.

In certain aspects, for a combined effect of strengthening and, the alloy has a Cu content of less than about 0.72 wt. % along with a controlled Si to Mg ratio of about 1.11:1.

In certain aspects, the alloy includes chromium (Cr) in an amount up to about 0.25% (e.g., from about 0.03% to about 0.06%, from about 0.03% to about 0.19%, or from about 0.06% to about 0.1%) based on the total weight of the alloy. For example, the alloy can include about 0.001%, about 0.002%, about 0.003%, about 0.004%, about 0.005%, about 0.006%, about 0.007%, about 0.008%, about 0.059%, about 0.01%, about 0.011%, about 0.012%, about 0.013%, about 0.014%, about 0.015%, about 0.016%, about 0.017%, about 0.018%, about 0.019%, about 0.02%, about 0.021%, about 0.022%, about 0.023%, about 0.024%, about 0.025%, about 0.026%, about 0.027%, about 0.028%, about 0.029%, about 0.03%, about 0.031%, about 0.032%, about 0.033%, about 0.034%, about 0.035%, about 0.036%, about 0.037%, about 0.038%, about 0.039%, about 0.04%, about 0.041%, about 0.042%, about 0.043%, about 0.044%, about 0.045%, about 0.046%, about 0.047%, about 0.048%, about 0.049%, about 0.05%, about 0.051%, about 0.052%, about 0.053%, about 0.054%, about 0.055%, about 0.056%, about 0.057%, about 0.058%, about 0.059%, about 0.06%, about 0.061%, about 0.062%, about 0.063%, about 0.064%, about 0.065%, about 0.066%, about 0.067%, about 0.068%, about 0.069%, about 0.07%, about 0.071%, about 0.072%, about 0.073%, about 0.074%, about 0.075%, about 0.076%, about 0.077%, about 0.078%, about 0.079%, about 0.08%, about 0.081%, about 0.082%, about 0.083%, about 0.084%, about 0.085%, about 0.086%, about 0.087%, about 0.088%, about 0.089%, about 0.09%, about 0.091%, about 0.092%, about 0.093%, about 0.094%, about 0.095%, about 0.096%, about 0.097%, about 0.098%, about 0.099%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, about 0.25%, about 0.26%, about 0.27%, about 0.28%, about 0.29%, about 0.3%, about 0.31%, about 0.32%, about 0.33%, about 0.34%, or about 0.25% Cr. All expressed in wt. %. In some cases, Cr is not present in the alloy (i.e., 0%). In some examples, Cr can control grain structure and prevent grain growth and recrystallization. Higher amounts of Cr can provide a higher formability and improved bendability in aged temper.

In certain examples, the alloy can include manganese (Mn) in an amount up to about 0.35% (e.g., from about 0.05% to about 0.18% or from about 0.1% to about 0.35%) based on the total weight of the alloy. For example, the alloy can include about 0.001%, about 0.002%, about 0.003%, about 0.004%, about 0.005%, about 0.006%, about 0.007%, about 0.008%, about 0.059%, about 0.01%, about 0.011%, about 0.012%, about 0.013%, about 0.014%, about 0.015%, about 0.016%, about 0.017%, about 0.018%, about 0.019%, about 0.02%, about 0.021%, about 0.022%, about 0.023%, about 0.024%, about 0.025%, about 0.026%, about 0.027%, about 0.028%, about 0.029%, about 0.03%, about 0.031%, about 0.032%, about 0.033%, about 0.034%, about 0.035%, about 0.036%, about 0.037%, about 0.038%, about 0.039%, about 0.04%, about 0.041%, about 0.042%, about 0.043%, about 0.044%, about 0.045%, about 0.046%, about 0.047%, about 0.048%, about 0.049%, about 0.05%, about 0.051%, about 0.052%, about 0.053%, about 0.054%, about 0.055%, about 0.056%, about 0.057%, about 0.058%, about 0.059%, about 0.06%, about 0.061%, about 0.062%, about 0.063%, about 0.064%, about 0.065%, about 0.066%, about 0.067%, about 0.068%, about 0.069%, about 0.07%, about 0.071%, about 0.072%, about 0.073%, about 0.074%, about 0.075%, about 0.076%, about 0.077%, about 0.078%, about 0.079%, about 0.08%, about 0.081%, about 0.082%, about 0.083%, about 0.084%, about 0.085%, about 0.086%, about 0.087%, about 0.088%, about 0.089%, about 0.09%, about 0.091%, about 0.092%, about 0.093%, about 0.094%, about 0.095%, about 0.096%, about 0.097%, about 0.098%, about 0.099%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, about 0.25%, about 0.26%, about 0.27%, about 0.28%, about 0.29%, about 0.3%, about 0.31%, about 0.32%, about 0.33%, about 0.34%, or about 0.35% Mn. In some cases, Mn is not present in the alloy (i.e., 0%). All expressed in wt. %.

In certain aspects, the alloy also includes iron (Fe) in an amount up to about 0.4% (e.g., from about 0.1% to about 0.25%, from about 0.18% to about 0.25%, from about 0.2% to about 0.21%, or from about 0.15% to about 0.32%) based on the total weight of the alloy. For example, the alloy can include about 0.01%, about 0.02%, about 0.03%, about 0.04%, about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, about 0.25%, about 0.26%, about 0.27%, about 0.28%, about 0.29%, about 0.3%, about 0.31%, about 0.32%, about 0.33%, about 0.34%, about 0.35%, about 0.36%, about 0.37%, about 0.38%, about 0.39%, or about 0.40% Fe. In some cases, Fe is not present in the alloy (i.e., 0%). All expressed in wt. %.

In certain aspects, the alloy includes zirconium (Zr) in an amount up to about 0.25% (e.g., from 0% to about 0.2%, from about 0.01% to about 0.25%, from about 0.01% to about 0.15%, from about 0.01% to about 0.1%, or from about 0.02% to about 0.09%) based on the total weight of the alloy. For example, the alloy can include about 0.001%, about 0.002%, about 0.003%, about 0.004%, about 0.005%, about 0.006%, about 0.007%, about 0.008%, about 0.009%, about 0.01%, about 0.02%, about 0.03%, about 0.04%, about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, or about 0.25% Zr. In certain aspects, Zr is not present in the alloy (i.e., 0%). All expressed in wt. %. In some examples, Zr can control grain structure and prevent grain growth and recrystallization. Higher amounts of Zr can provide a higher formability and improved bendability as well in T4 and aged temper.

In certain aspects, the alloy described herein includes zinc (Zn) in an amount up to about 1.0% (e.g., from about 0.001% to about 0.3%, from about 0.005% to about 0.09%, from about 0.004% to about 0.3%, from about 0.03% to about 0.2%, or from about 0.06% to about 0.1%) based on the total weight of the alloy. For example, the alloy can include about 0.001%, about 0.002%, about 0.003%, about 0.004%, about 0.005%, about 0.006%, about 0.007%, about 0.008%, about 0.009%, about 0.01%, about 0.011%, about 0.012%, about 0.013%, about 0.014%, about 0.015%, about 0.016%, about 0.017%, about 0.018%, about 0.019%, about 0.02%, about 0.021%, about 0.022%, about 0.023%, about 0.024%, about 0.025%, about 0.026%, about 0.027%, about 0.028%, about 0.029%, about 0.03%, about 0.04%, about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, about 0.25%, about 0.26%, about 0.27%, about 0.28%, about 0.29%, about 0.3%, about 0.31%, about 0.32%, about 0.33%, about 0.34%, about 0.35%, about 0.36%, about 0.37%, about 0.38%, about 0.39%, about 0.4%, about 0.41%, about 0.42%, about 0.43%, about 0.44%, about 0.45%, about 0.46%, about 0.47%, about 0.48%, about 0.49%, about 0.50%, about 0.51%, about 0.52%, about 0.53%, about 0.54%, about 0.55%, about 0.56%, about 0.57%, about 0.58%, about 0.59%, about 0.6%, about 0.61%, about 0.62%, about 0.63%, about 0.64%, about 0.65%, about 0.66%, about 0.67%, about 0.68%, about 0.69%, about 0.7%, about 0.71%, about 0.72%, about 0.73%, about 0.74%, about 0.75%, about 0.76%, about 0.77%, about 0.78%, about 0.79%, about 0.8%, about 0.81%, about 0.82%, about 0.83%, about 0.84%, about 0.85%, about 0.86%, about 0.87%, about 0.88%, about 0.89%, about 0.90%, about 0.91%, about 0.92%, about 0.93%, about 0.94%, about 0.95%, about 0.96%, about 0.97%, about 0.98%, about 0.99%, or about 1.0% Zn. In some cases, Zn is not present in the alloy (i.e., 0%). All expressed in wt. %. In certain aspects, Zn can benefit forming, including bending and the reduction of bending anisotropy in plate products.

In certain aspects, the alloy includes titanium (Ti) in an amount of up to about 0.3% (e.g., from about 0.01% to about 0.25%, from about 0.05% to about 0.2%, or up to about 0.1%) based on the total weight of the alloy. For example, the alloy can include about 0.01%, about 0.011%, about 0.012%, about 0.013%, about 0.014%, about 0.015%, about 0.016%, about 0.017%, about 0.018%, about 0.019%, about 0.02%, about 0.025%, about 0.03%, about 0.035%, about 0.04%, about 0.045%, about 0.05%, about 0.055%, 0.06%, about 0.065%, about 0.07%, about 0.075%, about 0.08%, about 0.085%, about 0.09%, about 0.095%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, about 0.25%, about 0.26%, about 0.27%, about 0.28%, about 0.29%, or about 0.3% Ti. All expressed in wt. %.

In certain aspects, the alloy includes nickel (Ni) in an amount up to about 0.04% (e.g., from 0% to about 0.02%, from about 0.01% to about 0.03%, from about 0.03% to about 0.04%) based on the total weight of the alloy. For example, the alloy can include about 0.001%, about 0.005%, about 0.01%, about 0.011%, about 0.012%, about 0.013%, about 0.014%, about 0.015%, about 0.016%, about 0.017%, about 0.018%, about 0.019%, about 0.02%, about 0.021%, about 0.022%, about 0.023%, about 0.024%, about 0.025%, about 0.026%, about 0.027%, about 0.028%, about 0.029%, about 0.03%, about 0.031%, about 0.032%, about 0.033%, about 0.034%, about 0.035%, about 0.036%, about 0.037%, about 0.038%, about 0.039%, or about 0.04% % Ni. In certain aspects, Ni is not present in the alloy (i.e., 0%). All expressed in wt. %.

Optionally, the alloy compositions can further include other minor elements, sometimes referred to as impurities, in amounts of about 0.05% or below, about 0.04% or below, about 0.03% or below, about 0.02% or below, or about 0.01% or below each. These impurities may include, but are not limited to, V, Ga, Ca, Hf, Sr, Sc, Sn, or combinations thereof. Accordingly, V, Ga, Ca, Hf, Sr, Sc, or Sn may be present in an alloy in amounts of about 0.05% or below, about 0.04% or below, about 0.03% or below, about 0.02% or below, or about 0.01% or below. In certain aspects, the sum of all impurities does not exceed about 0.15% (e.g., 0.1%). All expressed in wt. %. In certain aspects, the remaining percentage of the alloy is aluminum.

An exemplary alloy includes about 1.11% Si, about 0.72% Cu, about 1.00% Mg, about 0.22% Fe, about 0.3% Mn, about 0.021% Ti, about 0.03% Cr, about 0.2% Zn, about 0.034% Ni, and up to about 0.15% total impurities, with the remainder Al.

Another exemplary alloy includes about 0.7% Si, about 0.9% Cu, about 0.9% Mg, about 0.22% Fe, about 0.3% Mn, about 0.021% Ti, about 0.03% Cr, about 0.2% Zn, about 0.034% Ni, and up to about 0.15% total impurities, with the remainder Al.

Another exemplary alloy includes about 0.69% Si, about 0.79% Cu, about 0.9% Mg, about 0.22% Fe, about 0.03% Mn, about 0.023% Ti, about 0.25% Cr, about 0.063% Zn, about 0.0046% Ni, and up to about 0.15% total impurities (including about 0.016% V), with the remainder Al.

Methods of Making

In certain aspects, the disclosed alloy composition is a product of a disclosed method. Without intending to limit the disclosure, aluminum alloy properties are partially determined by the formation of microstructures during the alloy's preparation. In certain aspects, the method of preparation for an alloy composition may influence or even determine whether the alloy will have properties adequate for a desired application.

The alloys described herein can be cast using a casting method as known to those of skill in the art. For example, the casting process can include a Direct Chill (DC) casting process. Optionally, DC cast aluminum alloy products (e.g., ingots) can be scalped before subsequent processing. Optionally, the casting process can include a continuous casting (CC) process. Cast aluminum alloy products can then be subjected to further processing steps. In one non-limiting example, the processing method includes homogenizing, hot rolling, solutionizing, and quenching. In some cases, the processing steps further include annealing and/or cold rolling if desired. In some examples, the processing method also includes a pre-aging step. In some further cases, the processing method can also include a pre-straining step.

Homogenization

The homogenization step can include heating a cast aluminum alloy product, such as an ingot, prepared from an alloy composition described herein to attain a peak metal temperature (PMT) of about, or at least about, 520° C. (e.g., at least about 520° C., at least about 530° C., at least about 540° C., at least about 550° C., at least about 560° C., at least about 570° C., or at least about 580° C.). For example, the ingot can be heated to a temperature of from about 520° C. to about 580° C., from about 530° C. to about 575° C., from about 535° C. to about 570° C., from about 540° C. to about 565° C., from about 545° C. to about 560° C., from about 530° C. to about 560° C., or from about 550° C. to about 580° C. In some cases, the heating rate to the PMT can be about 100° C./hour or less, about 75° C./hour or less, about 50° C./hour or less, about 40° C./hour or less, about 30° C./hour or less, about 25° C./hour or less, about 20° C./hour or less, or about 15° C./hour or less. In other cases, the heating rate to the PMT can be from about 10° C./min to about 100° C./min (e.g., about 10° C./min to about 90° C./min, about 10° C./min to about 70° C./min, about 10° C./min to about 60° C./min, from about 20° C./min to about 90° C./min, from about 30° C./min to about 80° C./min, from about 40° C./min to about 70° C./min, or from about 50° C./min to about 60° C./min).

The cast aluminum alloy product is then allowed to soak (i.e., held at the indicated temperature) for a period of time. According to one non-limiting example, the cast aluminum alloy product is allowed to soak for up to about 18 hours (e.g., from about 30 minutes to about 18 hours, inclusively). For example, the cast aluminum alloy product can be soaked at a temperature of at least about 500° C. for about 30 minutes, about 1 hour, about 2 hours, about 3 hours, about 4 hours, about 5 hours, about 6 hours, about 7 hours, about 8 hours, about 9 hours, about 10 hours, about 11 hours, about 12 hours, about 13 hours, about 14 hours, about 15 hours, about 16 hours, about 17 hours, or about 18 hours, or anywhere in between.

Hot Rolling

Following the homogenization step, a hot rolling step can be performed. In certain cases, the cast aluminum alloy products are hot rolled with a hot mill entry temperature of about 440° C.-540° C. The entry temperature can be, for example, about 440° C., about 445° C., about 450° C., about 455° C., about 460° C., about 465° C., about 470° C., about 475° C., about 480° C., about 485° C., about 490° C., about 495° C., about 500° C., about 505° C., about 510° C., about 515° C., about 520° C., about 525° C., about 530° C., about 535° C., or about 540° C. In certain cases, the hot roll exit temperature can range from about 250° C.-about 380° C. (e.g., from about 330° C.-about 370° C.). For example, the hot roll exit temperature can be about 255° C., about 260° C., about 265° C., about 270° C., about 275° C., about 280° C., about 285° C., about 290° C., about 295° C., about 300° C., about 305° C., about 310° C., about 315° C., about 320° C., about 325° C., about 330° C., about 335° C., about 340° C., about 345° C., about 350° C., about 355° C., about 360° C., about 365° C., about 370° C., about 375° C., or about 380° C.

In certain cases, the cast aluminum alloy product can be hot rolled to an about 4 mm to about 15 mm thick gauge (e.g., from about 5 mm to about 12 mm thick gauge), which is referred to as a shate. For example, the cast aluminum alloy product can be hot rolled to an about 4 mm thick gauge, about 5 mm thick gauge, about 6 mm thick gauge, about 7 mm thick gauge, about 8 mm thick gauge, about 9 mm thick gauge, about 10 mm thick gauge, about 11 mm thick gauge, about 12 mm thick gauge, about 13 mm thick gauge, about 14 mm thick gauge, or about 15 mm thick gauge. In certain cases, the cast aluminum alloy product can be hot rolled to a gauge greater than about 15 mm thick (i.e., a plate). In other cases, the cast aluminum alloy product can be hot rolled to a gauge less than about 4 mm (i.e., a sheet). The temper of the as-rolled plates, shates and sheets is referred to as F-temper.

Optional Processing Steps: Annealing Step and Cold Rolling Step

In certain aspects, the hot-rolled aluminum alloy product undergoes further processing steps after the hot rolling step and before any subsequent steps (e.g., before a solutionizing step). Further processing steps may include an annealing procedure and a cold rolling step.

The annealing step can result in an aluminum alloy product with improved texture (e.g., an improved T4 alloy) with reduced anisotropy during forming operations, such as stamping, drawing, or bending. By applying the annealing step, the texture in the modified temper is controlled/engineered to be more random and to reduce those texture components (TCs) that can yield strong formability anisotropy (e.g., Goss, Goss-ND, or Cube-RD). This improved texture can potentially reduce the bending anisotropy and can improve the formability in the forming where a drawing or circumferential stamping process is involved, as it acts to reduce the variability in properties at different directions.

The annealing step can include heating the aluminum alloy product from room temperature to a temperature from about 300° C. to about 500° C. (e.g., from about 305° C. to about 495° C., from about 310° C. to about 490° C., from about 315° C. to about 485° C., from about 320° C. to about 480° C., from about 325° C. to about 475° C., from about 330° C. to about 470° C., from about 335° C. to about 465° C., from about 340° C. to about 460° C., from about 345° C. to about 455° C., from about 350° C. to about 450° C., from about 355° C. to about 445° C., from about 360° C. to about 440° C., or from about 365° C. to about 435° C., from about 400° C. to about 450° C., from about 425° C. to about 475° C., or from about 450° C. to about 500° C.).

The aluminum alloy product can soak at the temperature for a period of time. In one non-limiting example, the alloy is allowed to soak for up to approximately 4 hours (e.g., from about 15 to about 240 minutes, inclusively). For example, the sheet, plate, or shate can be soaked at the temperature of from about 400° C. to about 500° C. for about 15 minutes, about 20 minutes, about 25 minutes, about 30 minutes, about 35 minutes, about 40 minutes, about 45 minutes, about 50 minutes, about 55 minutes, about 60 minutes, about 65 minutes, about 70 minutes, about 75 minutes, about 80 minutes, about 85 minutes, about 90 minutes, about 95 minutes, about 100 minutes, about 105 minutes, about 110 minutes, about 115 minutes, about 120 minutes, about 125 minutes, about 130 minutes, about 135 minutes, about 140 minutes, about 145 minutes, about 150 minutes, about 155 minutes, about 160 minutes, about 165 minutes, about 170 minutes, about 175 minutes, about 180 minutes, about 185 minutes, about 190 minutes, about 195 minutes, about 200 minutes, about 205 minutes, about 210 minutes, about 215 minutes, about 220 minutes, about 225 minutes, about 230 minutes, about 235 minutes, or about 240 minutes, or anywhere in between. In certain aspects, the aluminum alloy product does not undergo an annealing step.

A cold rolling step can optionally be applied to the hot-rolled aluminum alloy product before the solutionizing step. In certain aspects, the hot-rolled aluminum alloy product (e.g., the aluminum alloy sheet, plate, or shate) can be cold rolled to a thinner gauge shate or a thinner gauge sheet.

Solutionizing

The solutionizing step can include heating an aluminum alloy sheet, plate, or shate from room temperature to a temperature of from about 500° C. to about 590° C. (e.g., from about 510° C. to about 585° C., from about 520° C. to about 580° C., from about 525° C. to about 575° C., from about 530° C. to about 570° C., from about 535° C. to about 565° C., from about 540° C. to about 560° C., or from about 545° C. to about 555° C.). The aluminum alloy sheet, plate, or shate can soak at the temperature for a period of time. In certain aspects, the aluminum alloy sheet, plate, or shate is allowed to soak for up to approximately 2 hours (e.g., from about 5 seconds to about 120 minutes inclusively). For example, the aluminum alloy sheet, plate, or shate can be soaked at the temperature of from about 525° C. to about 590° C. for about 5 seconds, about 10 seconds, about 15 seconds, about 20 seconds, about 25 seconds, about 30 seconds, about 35 seconds, about 40 seconds, about 45 seconds, about 50 seconds, about 55 seconds, about 60 seconds, about 65 seconds, about 70 seconds, about 75 seconds, about 80 seconds, about 85 seconds, about 90 seconds, about 95 seconds, about 100 seconds, about 105 seconds, about 110 seconds, about 115 seconds, about 120 seconds, about 125 seconds, about 130 seconds, about 135 seconds, about 140 seconds, about 145 seconds, about 150 seconds, about 5 minutes, about 10 minutes, about 15 minutes, about 20 minutes, about 25 minutes, about 30 minutes, about 35 minutes, about 40 minutes, about 45 minutes, about 50 minutes, about 55 minutes, about 60 minutes, about 65 minutes, about 70 minutes, about 75 minutes, about 80 minutes, about 85 minutes, about 90 minutes, about 95 minutes, about 100 minutes, about 105 minutes, about 110 minutes, about 115 minutes, or about 120 minutes, or anywhere in between.

In certain aspects, the heat treatment is performed immediately after the hot or cold rolling step. In certain aspects, the heat treatment is performed after an annealing step.

Quenching

In certain aspects, the aluminum alloy sheet, plate, or shate can then be cooled to a temperature of about 25° C. to about 65° C. at a quench speed that can vary between about 50° C./s to 400° C./s in a quenching step that is based on the selected gauge. For example, the quench rate can be from about 50° C./s to about 375° C./s, from about 60° C./s to about 375° C./s, from about 70° C./s to about 350° C./s, from about 80° C./s to about 325° C./s, from about 90° C./s to about 300° C./s, from about 100° C./s to about 275° C./s, from about 125° C./s to about 250° C./s, from about 150° C./s to about 225° C./s, or from about 175° C./s to about 200° C./s.

In the quenching step, the aluminum alloy sheet, plate, or shate is rapidly quenched with a liquid (e.g., water) and/or gas or another selected quench medium. In certain aspects, the aluminum alloy sheet, plate, or shate can be rapidly quenched with water. In certain aspects, the aluminum alloy sheet, plate, or shate can be quenched with air.

Pre-Aging, Pre-Straining, and/or Aging

Optionally, a pre-aging step, a pre-straining step, and/or an aging step can be performed prior to downstream thermal treatment processes (e.g., post-forming heat treatment). In some examples, a pre-aging step and an aging step can be performed. In other examples, a pre-aging step and a pre-straining step can be performed. In still other examples, a pre-aging step, a pre-straining step, and an aging step can be performed. In some cases, a pre-straining step and an aging step can be performed.

The pre-aging step can include heating the aluminum alloy sheet, plate, or shate after the solutionizing step to a temperature of from about 100° C. to about 160° C. (e.g., from about 105° C. to about 155° C., about 110° C. to about 150° C., about 115° C. to about 145° C., about 120° C. to about 140° C., about 125° C. to about 135° C.). In some examples, the pre-aging step can include heating the aluminum alloy sheet, plate, or shate after solutionizing from about 115° C. to about 135° C. (e.g., from about 120° C. to about 130° C.). The aluminum alloy sheet, plate, or shate can soak at the temperature for a period of time. In certain aspects, the aluminum alloy sheet, plate, or shate is allowed to soak for up to approximately 2 hours (e.g., for up to about 10 minutes, for up to about 20 minutes, for up to about 30 minutes, for up to about 40 minutes, for up to about 45 minutes, for up to about 60 minutes, for up to about 90 minutes). The time between solutionizing and pre-aging can be between 0 minutes and 60 minutes. For example, the time between solutionizing and pre-aging can be between about 5 minutes and about 45 minutes or between about 10 minutes and about 35 minutes. In some examples, pre-aging can inhibit natural age hardening of aluminum alloys. In some further examples, the pre-aging step can be combined with one or more downstream thermal treatment processes. Such a combination of the pre-aging step and downstream thermal treatment step(s) can provide an aluminum alloy product with high strength and high deformability (e.g., formability, bendability, crushability, or crashability).

The methods can optionally include a pre-straining step. The pre-straining step can include partially deforming the aluminum alloy sheet, plate, or shate in a direction longitudinal to a rolling direction. For example, the pre-straining step can include applying a tensile strain to the aluminum alloy sheet, plate, or shate providing up to about 10% elongation. For example, the elongation can be up to about 1%, up to about 2%, up to about 3%, up to about 4%, up to about 5%, up to about 6%, up to about 7%, up to about 8%, up to about 9%, or up to about 10%. In some further examples, the pre-straining step can be combined with one or more downstream thermal treatment processes. Such a combination of the pre-straining step and downstream thermal treatment processes can provide an aluminum alloy product with high strength and high deformability (e.g., formability, bendability, crushability, or crashability).

Optionally, the methods can further include an aging step. Optionally, the alloy can be naturally aged for a period of time to result in the T4 temper. In certain aspects, the alloy in the T4 temper can be artificially aged at about 160° C. to about 225° C. (e.g., about 165° C., about 170° C., about 175° C., about 180° C., about 185° C., about 190° C., about 195° C., about 200° C., about 205° C., about 210° C., about 215° C., about 220° C., or about 225° C.) for a period of time. Optionally, the alloy can be artificially aged for a period from about 5 minutes to about 10 hours (e.g., about 5 minutes, about 10 minutes, about 15 minutes, about 30 minutes, about 1 hour, about 2 hours, about 3 hours, about 4 hours, about 5 hours, about 6 hours, about 7 hours, about 8 hours, about 9 hours, or about 10 hours, or anywhere in between) to result in an exemplary temper. In some aspects, pre-aging the alloy after solutionizing the alloy to result in the exemplary temper can prevent further natural aging from occurring. Non-natural aging can provide constant material properties over time (e.g., yield strength and bendability do not degrade over time) and can reduce the difference of mechanical properties when subjecting the alloy to a downstream processing step (e.g., cold forming and/or stamping.).

Coiling

The aluminum alloy sheet, plate, or shate can be gathered at a terminal point of a production line to form an aluminum alloy coil.

Alloy Properties

Effect of Pre-Aging on Alloy Properties

In some non-limiting examples, the alloys described herein can have high strength and high formability and bendability when subjected to pre-aging after solutionizing, as compared to conventional heat treatable alloys not processed according to the methods described herein. In certain cases, the alloys also demonstrate a resistance to age hardening after solutionizing. In further examples, the alloys exhibit stable strength and formability after solutionizing.

In certain aspects, the aluminum alloys may have an in-service strength (e.g., strength of an aluminum alloy employed on a vehicle) of at least about 150 MPa. In non-limiting examples, the in-service strength is at least about 180 MPa, at least about 190 MPa, at least about 195 MPa, at least about 200 MPa, at least about 210 MPa, at least about 220 MPa, at least about 230 MPa, at least about 240 MPa, at least about 250 MPa, at least about 260 MPa, at least about 270 MPa, at least about 280 MPa, at least about 290 MPa, at least about 295 MPa, at least about 300 MPa, at least about 305 MPa, at least about 310 MPa, at least about 315 MPa, at least about 320 MPa, at least about 325 MPa, at least about 330 MPa, at least about 335 MPa, at least about 340 MPa, at least about 345 MPa, at least about 350 MPa, at least about 355 MPa, or at least about 360 MPa. In some cases, the in-service strength is from about 240 MPa to about 340 MPa. For example, the in-service strength can be from about 150 MPa to about 295 MPa, from about 175 MPa to about 275 MPa, from about 200 MPa to about 250 MPa, from about 180 MPa to about 190 MPa, or from about 185 MPa to about 195 MPa.

In certain aspects, the alloys exhibit a uniform elongation of greater than or equal to 19% and a total elongation of greater than or equal to 25%. In certain aspects, the alloys exhibit a uniform elongation of greater than or equal to 22% and a total elongation of greater than or equal to 27%. For example, the alloys can exhibit a uniform elongation of 19% or more, 20% or more, 21% or more, 22% or more, 23% or more, 24% or more, 25% or more, 26% or more, 27% or more, or 28% or more. The alloys can exhibit a total elongation of 25% or more, 26% or more, 27% or more, 28% or more, 29% or more, or 30% or more.

The mechanical properties of the aluminum alloys can be controlled by various processing conditions depending on the desired use. As one example, the alloys can be produced (or provided) in the T3 temper, the T4 temper, the T6 temper or the T8 temper. In some non-limiting examples, T4 sheets, plates, and shates can be subjected to additional processing treatment(s) to meet strength requirements upon receipt and further processing by an end user. In some cases, the alloy can be provided in a T4 temper after being subjected to a pre-aging step, wherein the pre-aging step enables the alloy to achieve T6 temper properties after an end user's paint bake procedure. For example, sheets, plates, and shates can be delivered in T4 temper, coated via Zn-phosphating and electro-coating (E-coating) by an end user, and thermally treated (e.g., paint baked) to cure the coating. Paint baking a pre-aged aluminum alloy can complete an artificial aging process providing an aluminum alloy product exhibiting mechanical properties of an aluminum alloy product delivered in a T6 temper. Surprisingly, combining pre-aging with paint baking provides high strength, comparable to levels observed in T6 temper aluminum alloys, and high deformability, comparable to levels observed in T4 temper aluminum alloys.

Effect of Pre-Straining on Alloy Properties

In some cases, the alloys can be provided in a T3 temper after being subjected to a pre-straining step. In some non-limiting examples, T3 sheets, plates, and shates can be subjected to additional processing treatment(s) to meet strength requirements upon receipt and further processing by an end user. In some cases, the alloys can be provided in a T3 temper after being subjected to a pre-straining step. The pre-straining step enables the alloys to achieve T6 temper properties after an end user's forming and post-forming heat treatment (PFHT) procedures. For example, sheets, plates, and shates can be delivered in T3 temper, formed into an aluminum alloy part by an end user, and thermally treated (e.g., by applying a PFHT). Applying a PFHT to a pre-strained aluminum alloy can complete an artificial aging process providing an aluminum alloy product exhibiting the mechanical properties of an aluminum alloy product delivered in a T6 temper. Surprisingly, combining pre-straining with PFHT provides high strength, comparable to levels observed in T6 temper aluminum alloys, and high deformability, comparable to levels observed in T4 temper aluminum alloys. In certain aspects, the pre-strained alloys exhibit a uniform elongation of 12% or greater (e.g., greater than 15% or greater than 20%) for a 10% prestrain.

Methods of Using

The alloys and methods described herein can be used in automotive, electronics, and transportation applications, such as commercial vehicle, aircraft, or railway applications. For example, the aluminum alloy products described herein could be used for chassis, cross-member, and intra-chassis components (encompassing, but not limited to, all components between the two C channels in a commercial vehicle chassis) to gain strength, serving as a full or partial replacement of high-strength steels. In certain aspects, the aluminum alloy products are useful in applications where the processing and operating temperature is approximately 100° C. or lower.

In certain aspects, the alloys and methods can be used to prepare motor vehicle body part products. For example, the disclosed alloys and methods can be used to prepare automobile body parts, such as bumpers, side beams, roof beams, cross beams, pillar reinforcements (e.g., A-pillars, B-pillars, and C-pillars), inner panels, side panels, floor panels, tunnels, structure panels, reinforcement panels, inner hoods, or trunk lid panels. The disclosed aluminum alloys and methods can also be used in aircraft or railway vehicle applications, to prepare, for example, external and internal panels. In certain aspects, the disclosed alloys can be used for other specialties applications, such as automotive battery plates/shates.

In certain aspects, the products created from the alloys and methods can be coated. For example, the disclosed products can be Zn-phosphated and electrocoated (E-coated). As part of the coating procedure, the coated samples can be baked to dry the E-coat at about 160° C. to about 205° C. for about 10 minutes to about 30 minutes (e.g., about 170° C. for 25 minutes, about 200° C. for 15 minutes, or about 180° C. for 20 minutes). In certain aspects, a paint bake response is observed wherein the alloys exhibit an increase in yield strength. In certain examples, the paint bake response is employed to complete an artificial aging process initiated by a pre-aging step employed during aluminum alloy production.

In certain aspects, the products created from the alloys and methods can be formed. For example, the disclosed products can be drawn or circumferentially stamped. As part of the forming procedure, the formed samples can be baked to anneal the formed aluminum alloy part at about 160° C. to about 225° C. for about 15 minutes to about 45 minutes (e.g., about 180° C. for 35 minutes, about 215° C. for 25 minutes, or about 195° C. for 30 minutes). In certain aspects, an artificial aging response is observed wherein the alloys exhibit an increase in yield strength. Surprisingly, the alloys do not exhibit a loss of deformability normally observed in artificially aged aluminum alloys. The alloys and methods described herein provide high strength alloys that are also highly deformable.

The described alloys and methods can also be used to prepare housings for electronic devices, including mobile phones and tablet computers. For example, the alloys can be used to prepare housings for the outer casing of mobile phones (e.g., smart phones) and tablet bottom chassis, with or without anodizing. Exemplary consumer electronic products include mobile phones, audio devices, video devices, cameras, laptop computers, desktop computers, tablet computers, televisions, displays, household appliances, video playback and recording devices, and the like. Exemplary consumer electronic product parts include outer housings (e.g., facades) and inner pieces for the consumer electronic products.

In certain examples, the alloys can be used in an exemplary temper as described herein. In certain aspects, the alloys and methods described herein results in a high-strength alloy including formability properties normally observed in lower strength alloys. Additionally, the resulting exemplary temper can provide alloys that do not naturally age-harden over time. A non-natural aging alloy can be stored indefinitely and retain desirable mechanical properties including high-strength, high formability and a favorable paint bake response.

The following examples will serve to further illustrate the present invention without, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

EXAMPLES

Example 1: Effect of Pre-Aging after Solutionizing on Natural Aging

An exemplary 6xxx series aluminum alloy was produced according to the methods described herein. Addition of a pre-aging step after the solutionizing step provided an aluminum alloy in a pre-aged condition resulting in an exemplary temper. Normally, 6xxx alloys age-harden over time when stored at room temperature. This age-hardening is demonstrated by a logarithmic increase in tensile strength (Rp02) over time (see FIG. 1 "no PX," referring to no pre-aging). Pre-aging the alloy after solutionizing the alloy can pre-age the alloy before artificial or natural aging can be employed in optional downstream processing. With this exemplary pre-aging, the alloy stays at the same Rp02 level when stored for a period of time at room temperature. FIG. 1 compares the effect of the pre-aging at two different temperatures to a sample that was not pre-aged. The top curve corresponds to pre-aging at 120° C. for 2 hours (this curve is also typical of alloys subjected to coil cooling from 130° C.); the middle curve corresponds to pre-aging at 100° C. for 2 hours (this curve is also typical of alloys subjected to coil cooling from 110° C.); and the bottom curve corresponds to samples that were not subjected to a pre-aging step (this curve is also typical of alloys subjected to coil cooling from less than 50° C.), referred to as "no PX."

A pre-aged alloy resistant to natural age-hardening can exhibit an increased shelf life (e.g., for up to greater than 1 year) for storing as-produced aluminum alloys. In order to demonstrate the effect of the exemplary temper on the mechanical properties, the exemplary alloy with the composition described in Table 4 above was produced with different pre-aging temperatures. The various temperatures were recorded at the exit of the pre-aging furnace: 50° C. (no PX), 110° C. (100° C./2 hours) and 130° C. (120° C./2 hours). The exemplary alloy pre-aged at 120° C. demonstrated a higher yield strength than those pre-aged at 100° C. and not pre-aged, and the yield strength remained stable over a period of time.

Example 2: Effect of Pre-Aging after Solutionizing on Formability

Figure 2:
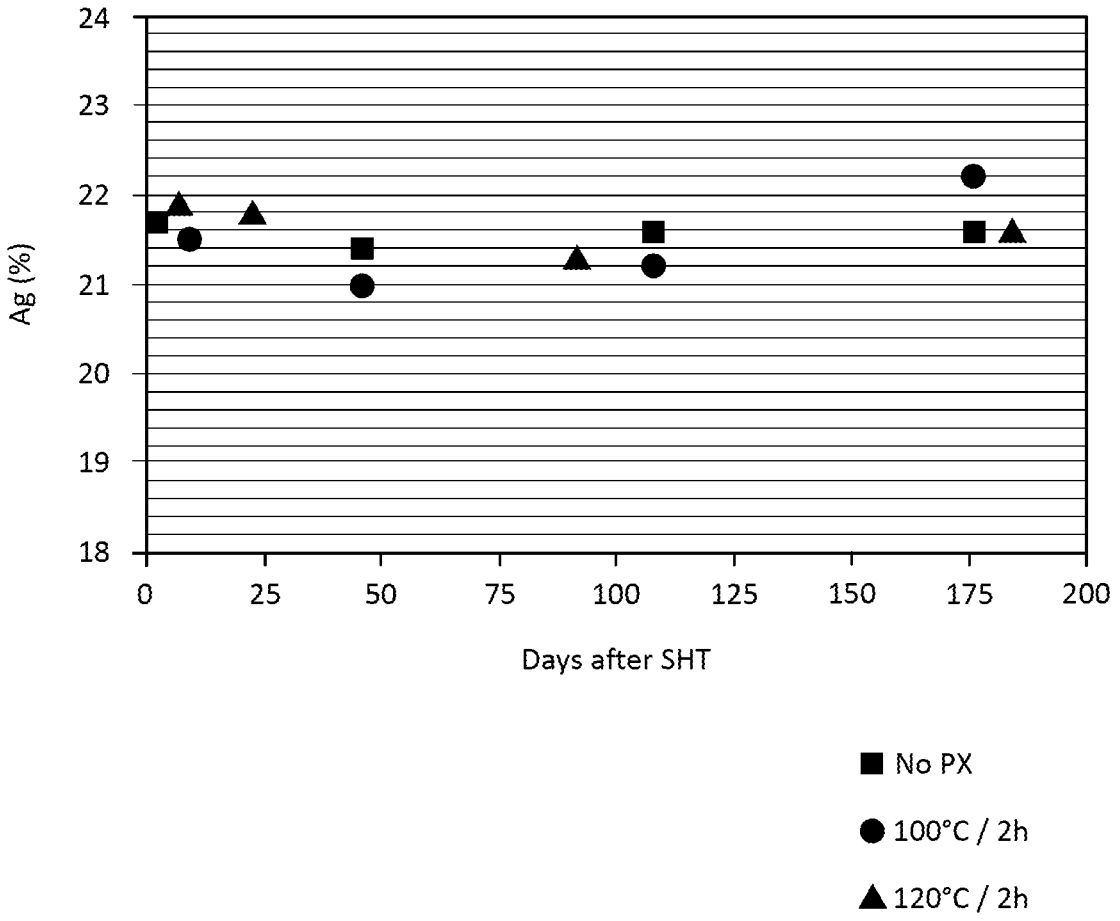
FIG. 2 is a graph showing a comparison between the elongation over time of an exemplary alloy exposed to various pre-aging conditions after solutionizing.

An exemplary alloy with the composition described in Table 4 was produced with different pre-aging temperatures as described in Example 1. FIG. 2 shows the stability of the elongation (Ag) over time for the exemplary alloy in the exemplary temper. The elongation is highly stable and does not decrease as strength increases.

Example 3: Effect of Pre-Aging after Solutionizing on Paint Bake Response

Figure 3:
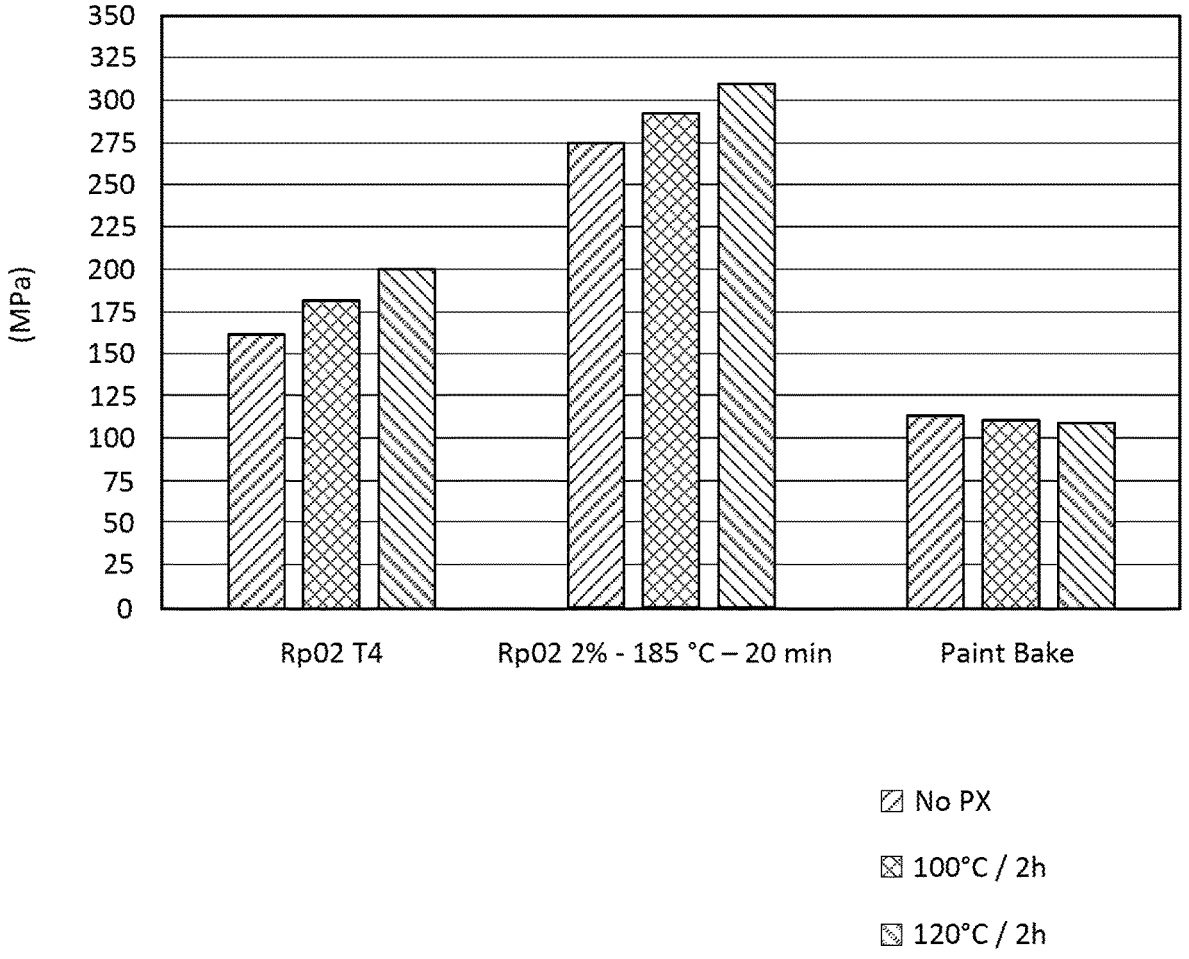
FIG. 3 is a graph showing a comparison between the paint bake response of an exemplary alloy exposed to various pre-aging conditions after solutionizing.

An exemplary alloy with the composition described in Table 4 was produced with different pre-aging temperatures as described in Example 1. FIG. 3 shows the effect of the pre-aging after solutionizing of an aluminum alloy on an optional downstream process wherein a coated aluminum alloy is heated to cure the coating. Coat curing, or paint baking, is known to a person of ordinary skill in the art to further artificially age an aluminum alloy and further increase the yield strength of the alloy. An exemplary alloy sample was subjected to a paint bake of 185° C. for 20 minutes after solutionizing and after pre-straining by 2%. FIG. 3 demonstrates the increased yield strength after paint baking of the exemplary alloy in the exemplary temper (center group of histograms) compared to the yield strength after paint baking of the exemplary alloy in T4 temper (left group of histograms). The right group of histograms referred to as "Paint Bake" indicates the difference in the paint bake response of the alloys in the exemplary temper over the alloys in T4 temper. The left histogram bar in each group corresponds to the sample that was not pre-aged ("no PX"); the center histogram bar in each group corresponds to the sample pre-aged at conditions of 100° C./2 hours; and the right histogram bar in each group corresponds to the sample pre-aged at conditions of 120° C./2 hours. This example shows that a very high paint bake response can be achieved with the exemplary alloys. The exemplary alloys demonstrated yield strength greater than 300 MPa when pre-aged at 120° C. for 2 hours after solutionizing, pre-straining by 2% and paint baking at 185° C. for 20 minutes.

Example 4: Effect of Pre-Aging Temperature on Mechanical Properties

Figure 4:
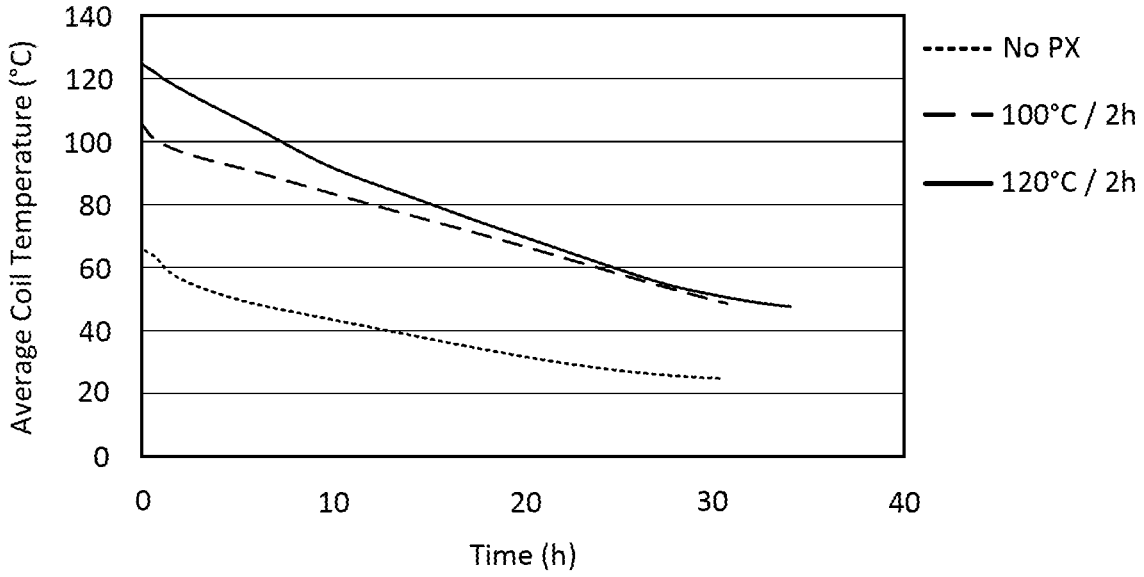
FIG. 4 is a graph showing a comparison between the coil cooling rates of an exemplary alloy exposed to various pre-aging conditions after solutionizing.

As described above, three different pre-aging conditions were considered. Coil cooling rates were recorded upon exit from a continuous heat treatment line. Coil cooling curves are presented in FIG. 4. A non-pre-aged coil cools to room temperature faster than the pre-aged coils (bottom curve, no PX). The cooling rate curves for the pre-aged coils show a higher initial cooling rate for the coil pre-aged at a higher temperature (top curve, 120° C./2 hours). The middle curve shows the cooling rate for the coil pre-aged at 100° C./2 hours. The cooling rates for the pre-aged coils eventually equilibrate allowing the pre-aged coils to arrive at similar temperatures after similar periods of time.

Figure 5:
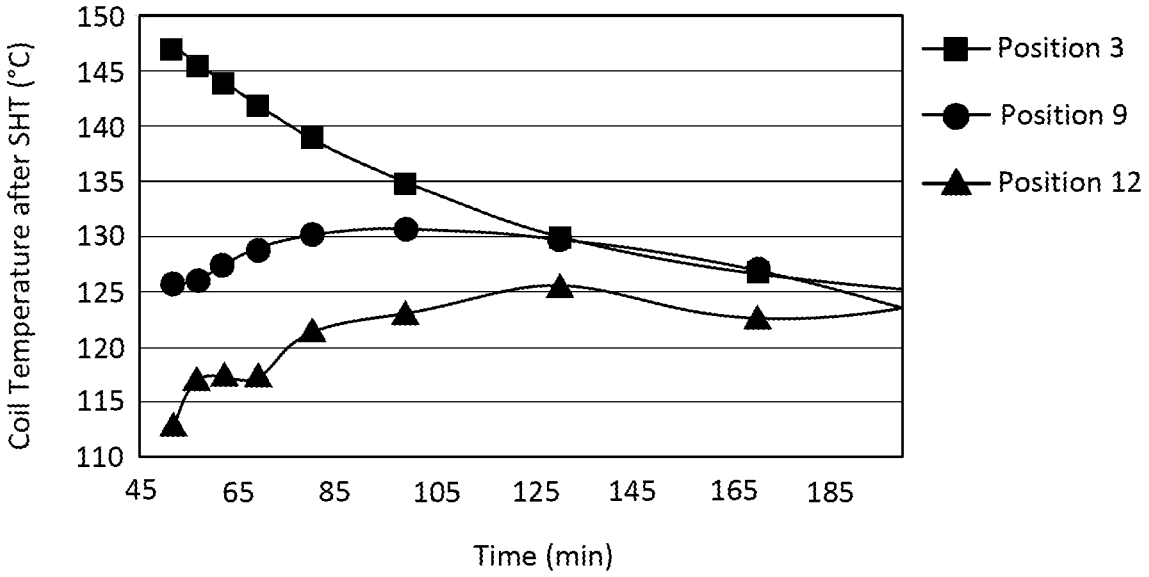
FIG. 5 is a graph showing the temperature coil cooling rates of a comparative aluminum alloy at various positions over the coil diameter after pre-aging.
Figure 6:
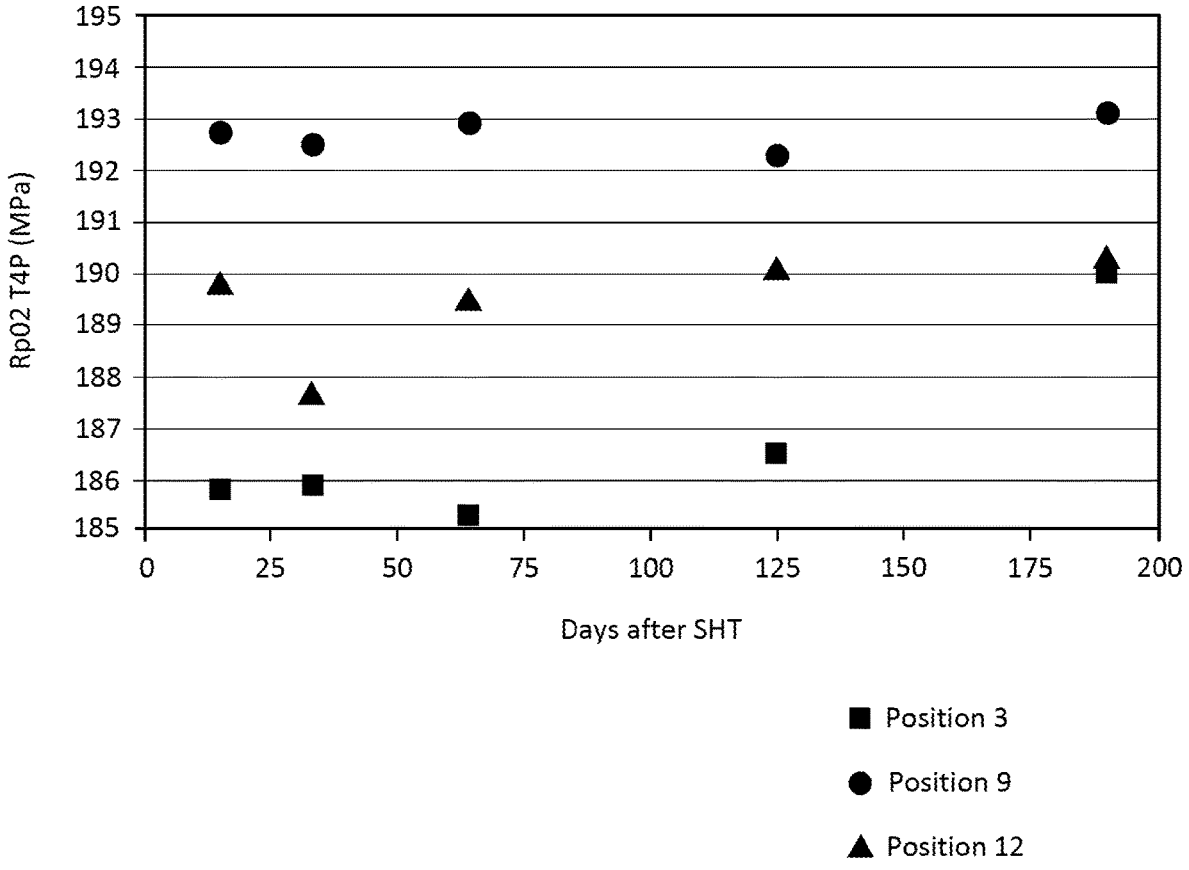
FIG. 6 is a graph showing a comparison of yield strength stability over time of an exemplary alloy in T4 temper at various positions over the coil diameter.
Figure 7:
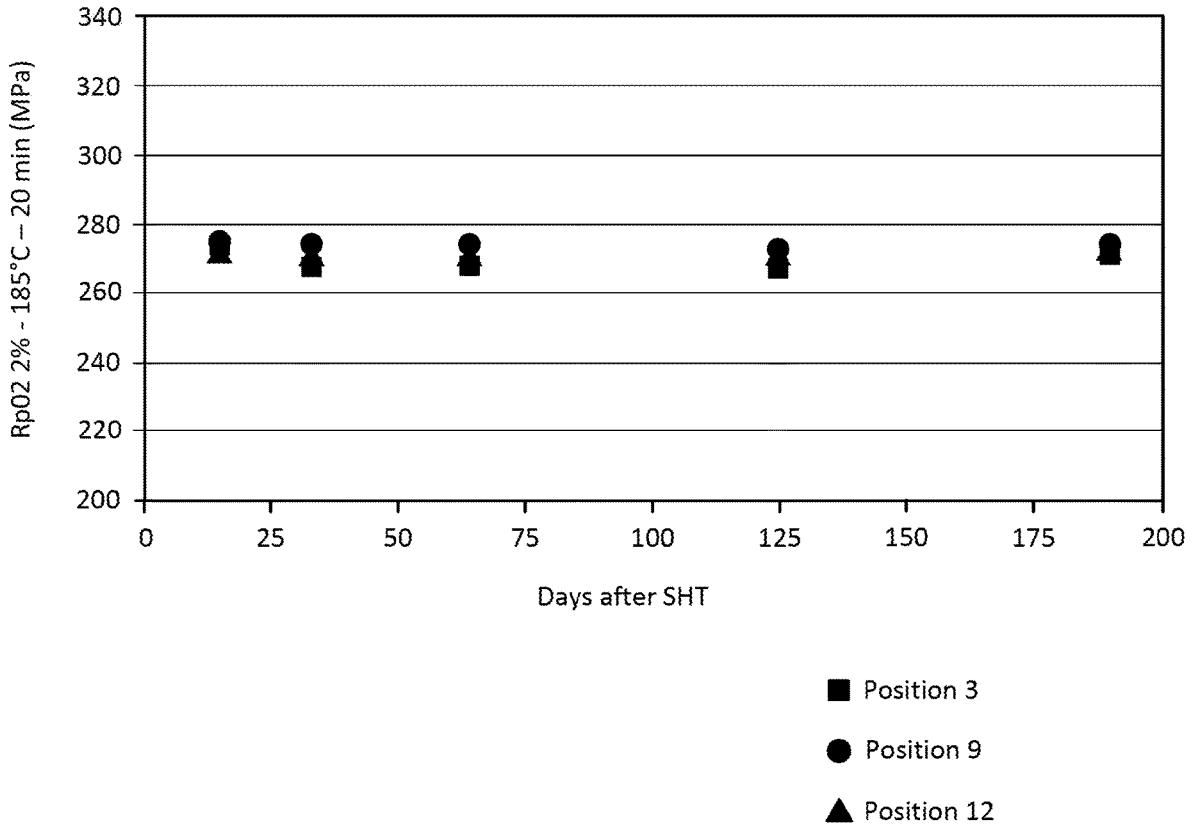
FIG. 7 is a graph showing a comparison of paint bake response stability over time of an exemplary alloy at various positions over the coil diameter.
Figure 8:
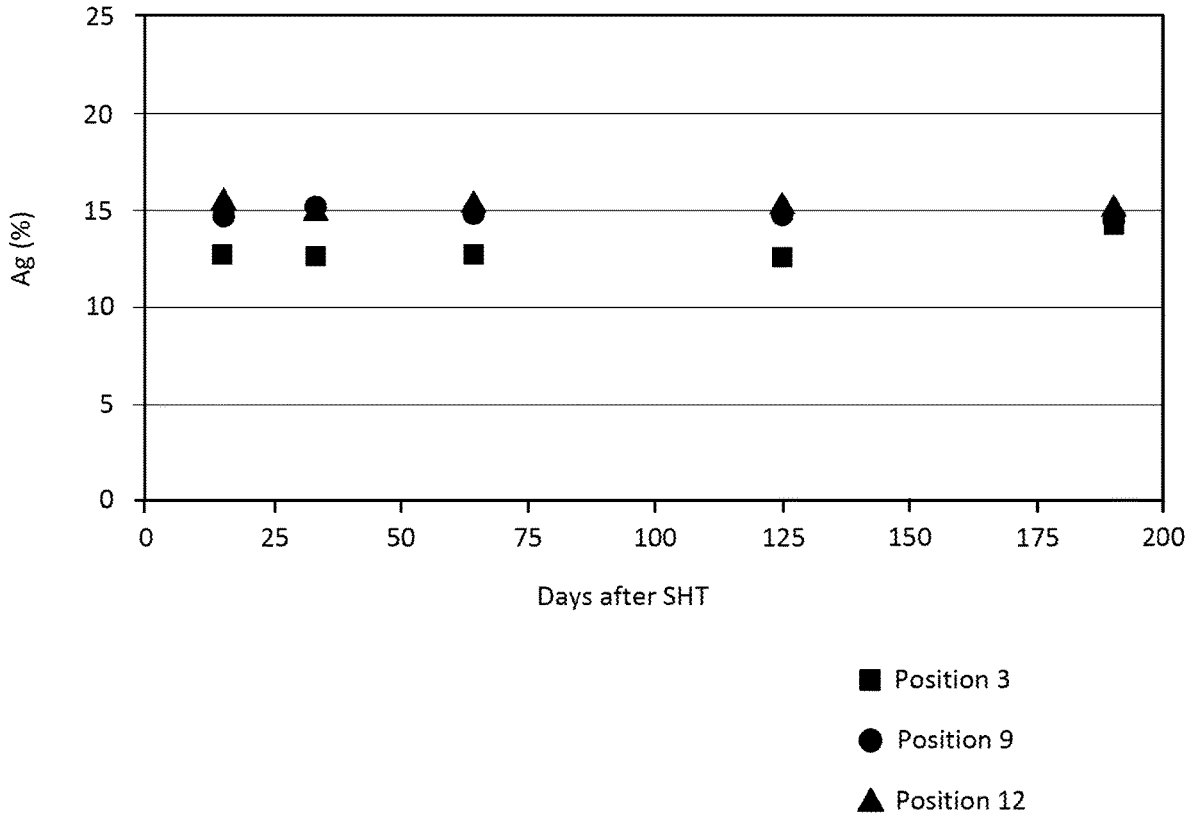
FIG. 8 is a graph showing a comparison of elongation stability over time of an exemplary alloy at various positions over the coil diameter.

A comparative alloy, AA6014, was subjected to the methods described herein resulting in the exemplary temper and naturally aged resulting in T4 temper. FIG. 5 presents the temperature data recorded on the coil at three different positions upon exit from the heat treatment line. Over time, the temperature of the coil equilibrated resulting in roughly the same temperature across the entirety of the coil, about 125° C. FIG. 6 shows the stability of the yield strength of the comparative AA6014 aluminum alloy in T4 temper over time of samples taken from the three different positions. The varied yield strengths of the different samples exhibits a non-uniform aging within the coil. FIG. 7 presents the yield strength data from the comparative AA6014 alloy subjected to the pre-aging step resulting in the exemplary temper. The recorded yield strengths are similar for each of the samples taken from different positions suggesting a uniform aluminum alloy coil. Additionally, there is no evidence of natural aging after solutionizing demonstrating the effect of the exemplary temper. FIG. 8 presents the elongation (Ag) data from the comparative AA6014 alloy subjected to the pre-aging step resulting in the exemplary temper. The elongation data suggest uniform formability as well as resistance to natural aging of the alloy in the exemplary temper.

Figure 9:
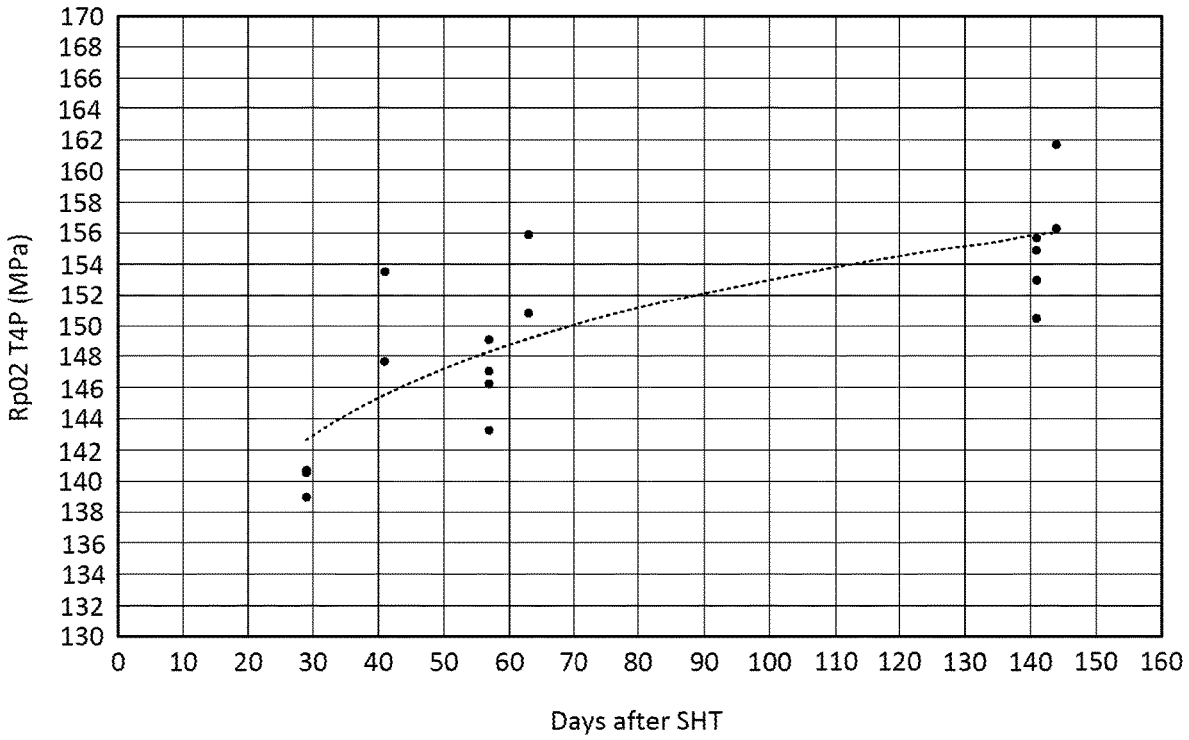
FIG. 9 is a graph showing natural age hardening of a comparative alloy subjected to a pre-aging temperature of 100° C. after solutionizing.
Figure 10:
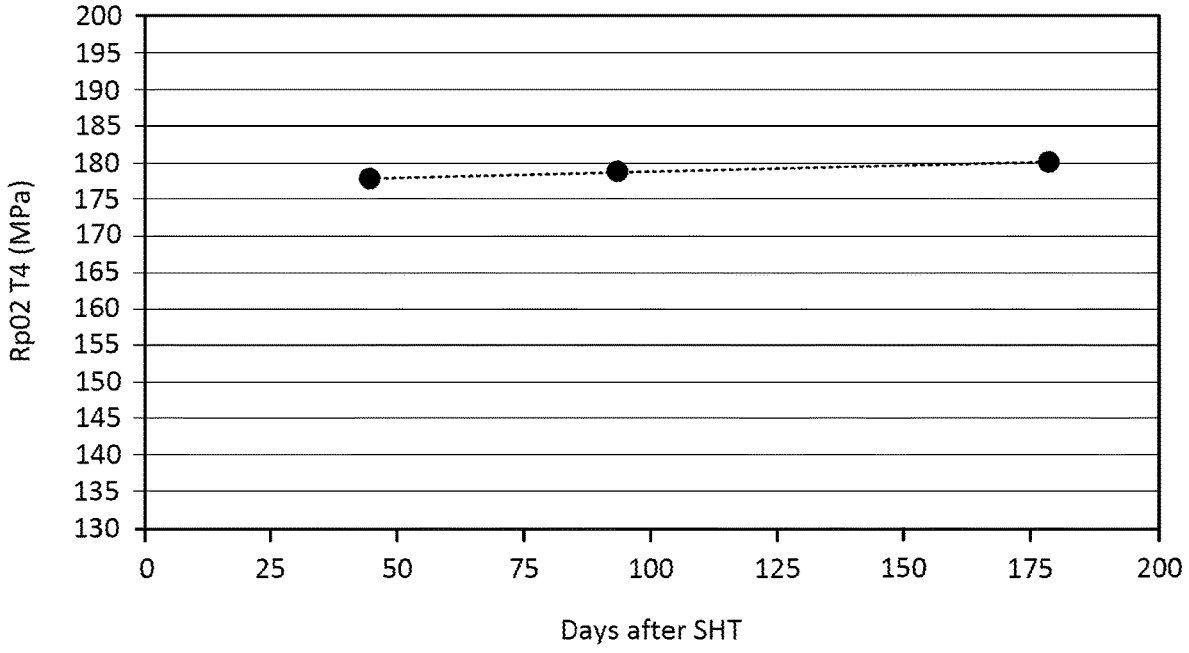
FIG. 10 is a graph showing natural age hardening of an exemplary alloy subjected to a pre-aging temperature of 130° C. after solutionizing.

A second comparative alloy, AA6111, was subjected to pre-aging to result in the exemplary temper. The comparative AA6111 was pre-aged at 100° C. for 2 hours after solutionizing. After solutionizing, the comparative AA6111 alloy was stored at room temperature and yield strength was tested periodically. FIG. 9 presents the yield strength stability of the comparative AA6111 in exemplary temper. The effects of natural aging are evident in the graph as a 30-40 MPa increase in yield strength was observed over a period of about 5 months. The comparative AA6111 alloy in the exemplary temper was pre-aged at 120° C. for 2 hours (or coil cooled from 130° C.) after solutionizing and stored at room temperature. Yield strength was tested periodically. FIG. 10 shows the results of the strength tests, indicating a very slight increase in yield strength (about 2 MPa) over a period of about 6 months, demonstrating the resistance to natural aging of the comparative AA6111 alloy in the exemplary temper, showing the desired properties of the exemplary temper can be composition specific (i.e., the exemplary temper does not show resistance to natural aging in all 6xxx series aluminum alloys).

Example 5: Process Optimization

Figure 11:
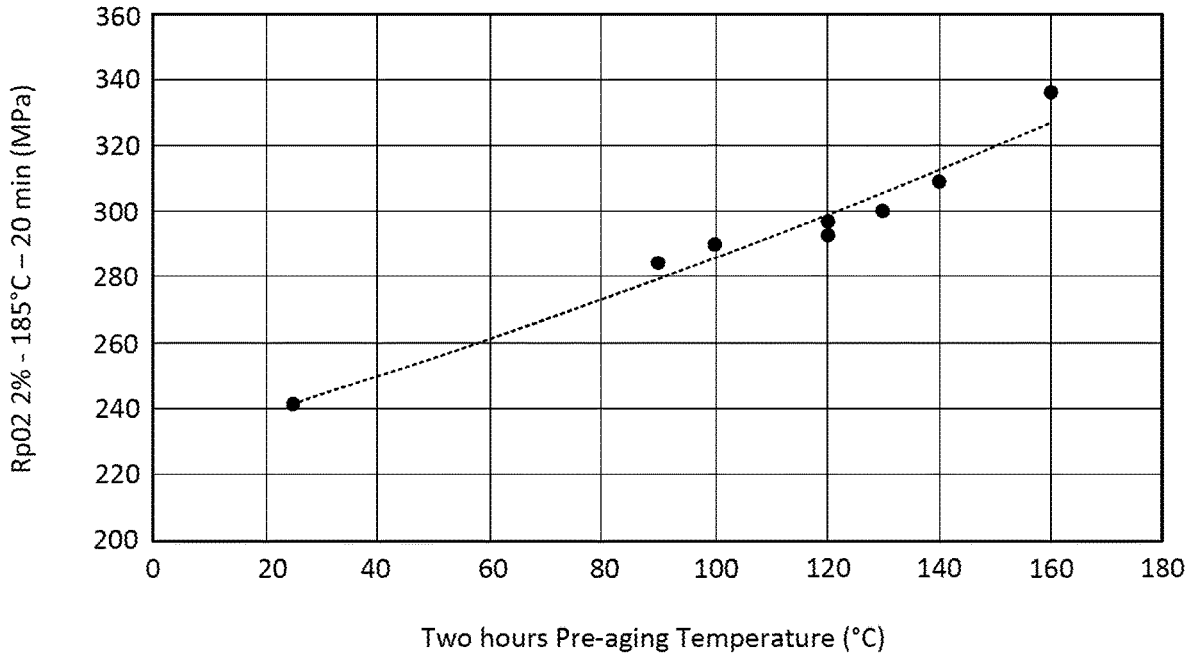
FIG. 11 is a graph showing a comparison of in-service yield strength of an exemplary alloy in an exemplary temper subjected to various pre-aging temperatures after solutionizing.
Figure 12:
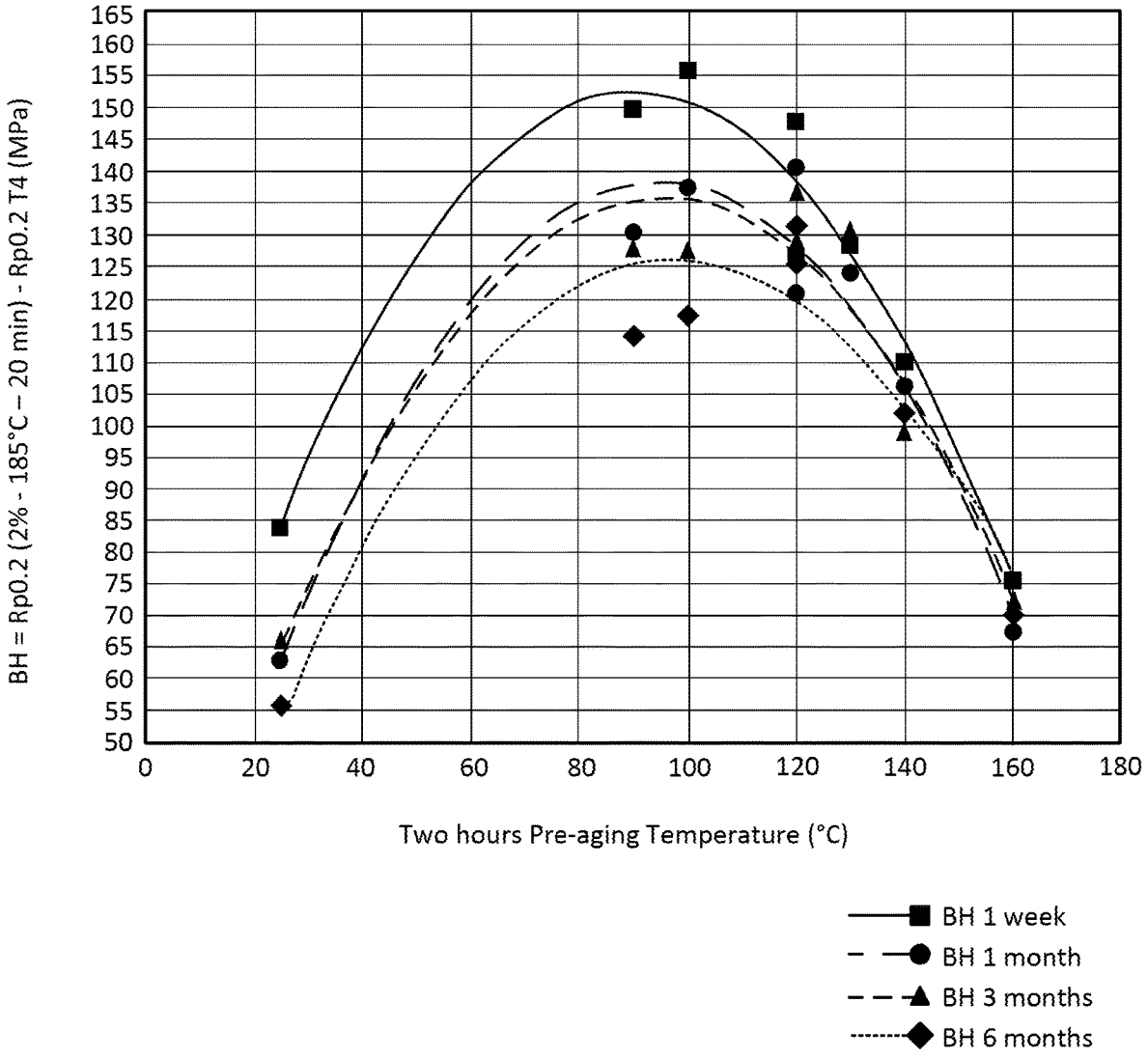
FIG. 12 is a graph showing a comparison of paint bake response over time of an exemplary alloy subjected to various pre-aging temperatures after solutionizing.
Figure 13:
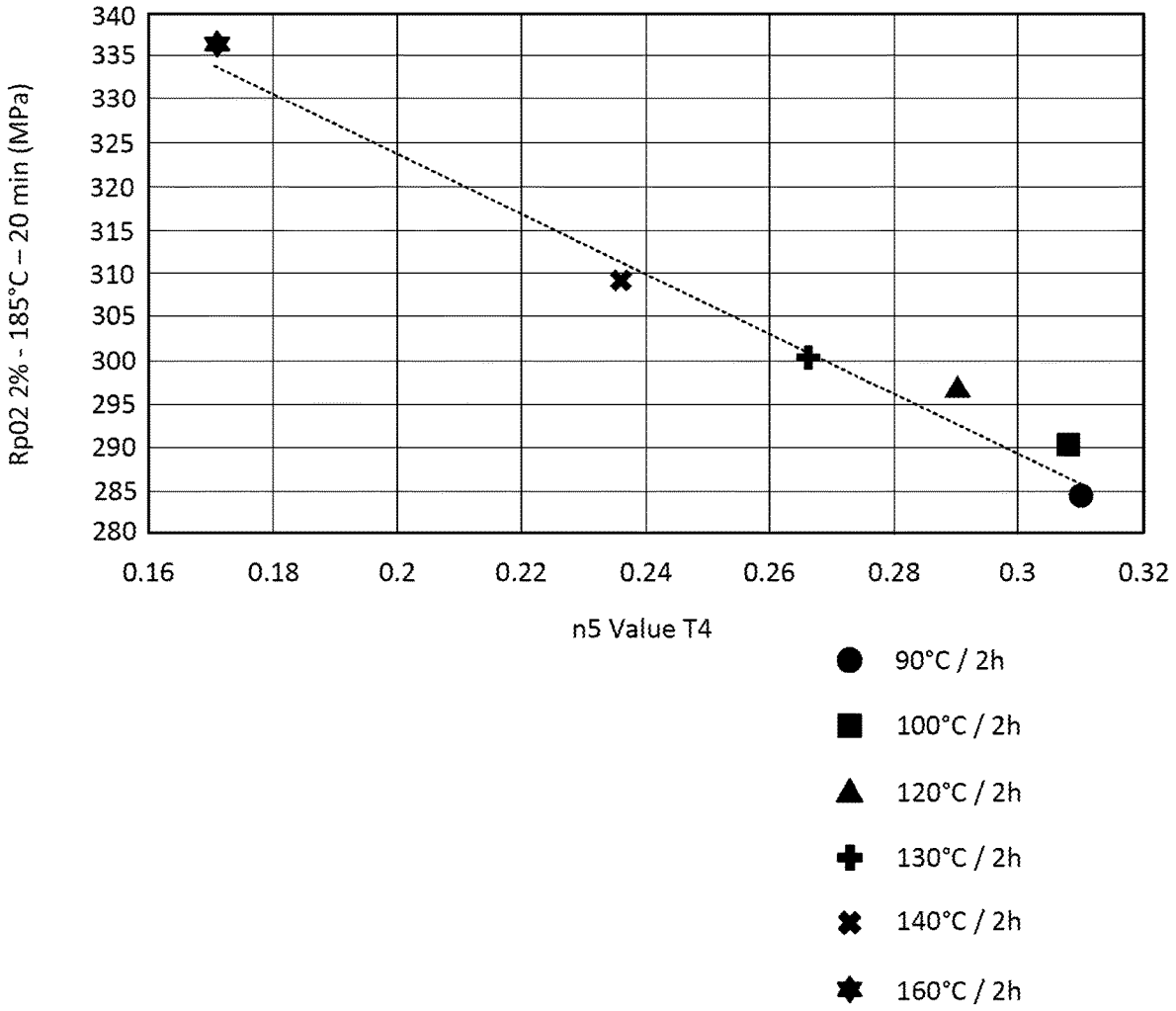
FIG. 13 is a graph showing a comparison of n-value of an exemplary alloy subjected to various pre-aging temperatures after solutionizing.

A variety of pre-aging temperatures were evaluated for optimal resulting properties. FIG. 11 shows the effect on the in service yield strength after 2% pre-strain and temperature aging of 185° C. for 20 minutes for a range of pre-aging temperatures on the paint bake. Higher pre-aging temperatures resulted in very high yield strength after solutionizing and paint baking. FIG. 12 shows the paint bake response as a function of: the difference in the paint bake response of the alloys in the exemplary temper as compared to the alloys in T4 temper (referred to as "BH" in FIG. 12); versus various pre-aging temperatures and various natural aging (e.g., 1 week, 1 month, 3 months, and 6 months). For an exemplary alloy as described herein (see Table 4), an optimum pre-aging temperature for maximum bake hardening is 100° C./2 hours (or coil cooling from 110° C.). However, to provide stable mechanical properties over time, the optimum pre-aging temperature is from about 110° C. to about 120° C. for 2 hours (which is similar to coil cooling from about 120 to about 130° C., a typical exit temperature from a pre-aging furnace on a continuous heat treatment line). Further optimization included a formability study. FIG. 13 presents the paint bake response as a function of the strain hardening exponent (n-value) in T4 temper. A higher n-value indicates higher formability in T4 temper. An n-value of at least 0.23 is required for 6xxx series aluminum alloys in T4 temper and is desired for aluminum alloys in the exemplary temper to have desired formability. The graph indicates the optimal pre-aging temperature is from about 115° C. to about 135° C., preferably from 120° C. to 130° C.

Figure 14:
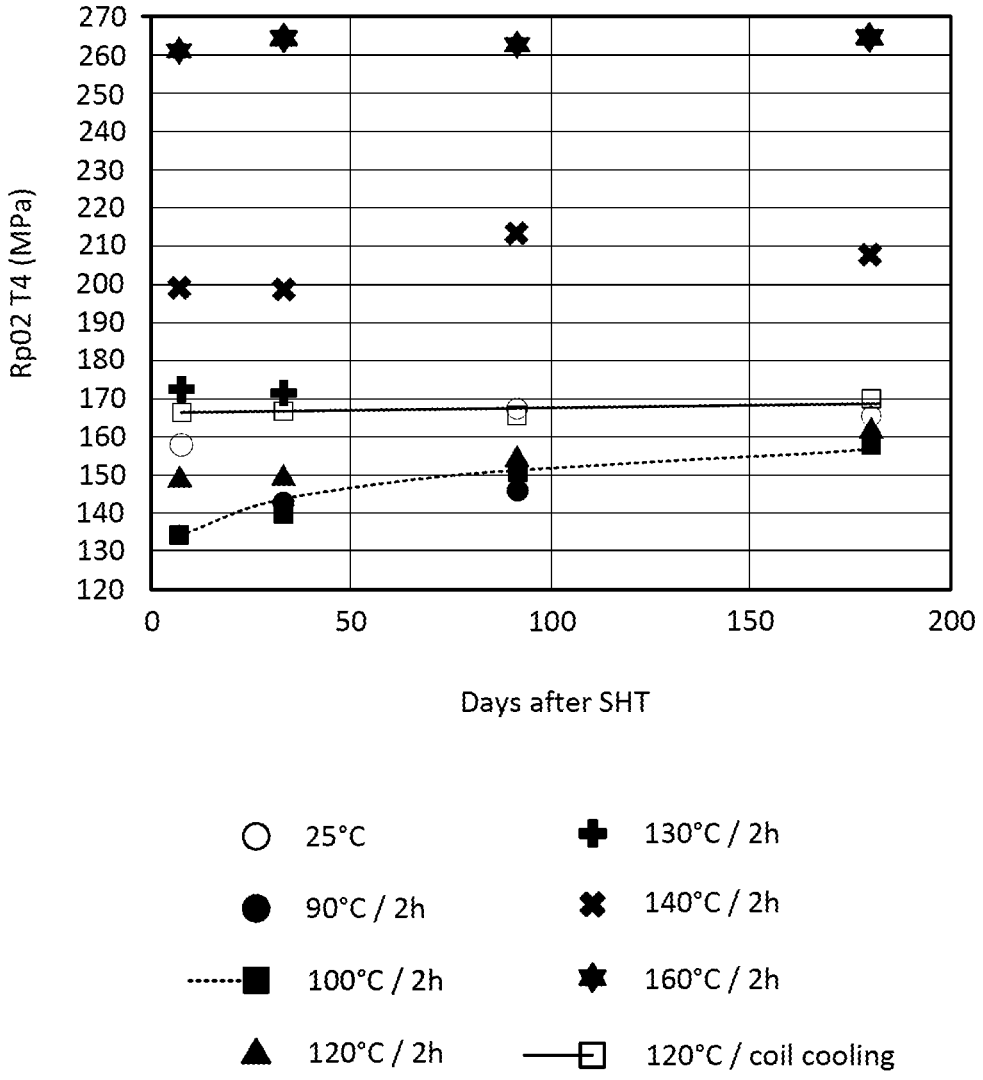
FIG. 14 is a graph showing a comparison of yield strength stability over time of an exemplary alloy subjected to various pre-aging temperatures after solutionizing.
Figure 15:
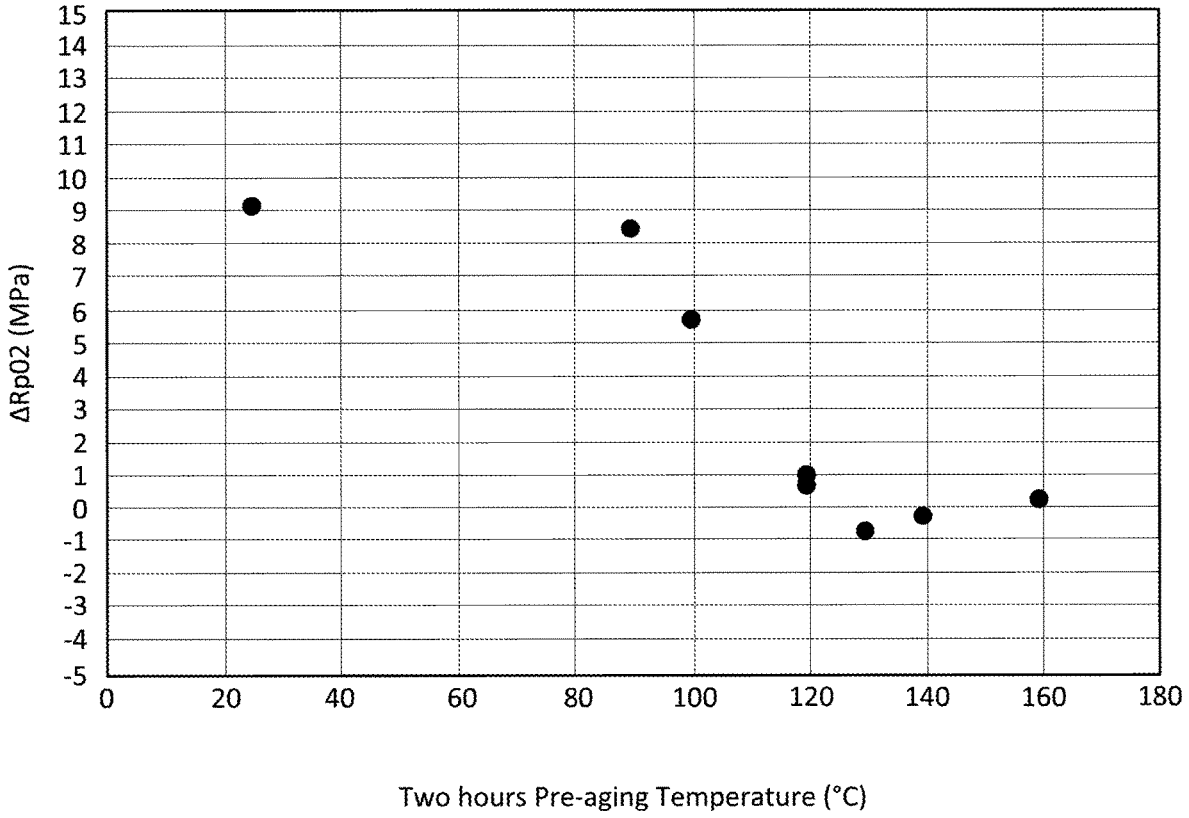
FIG. 15 is a graph showing the aging difference of yield strength (Rp02) after 1 month of aging of an exemplary alloy subjected to various pre-aging temperatures after solutionizing.
Figure 16:
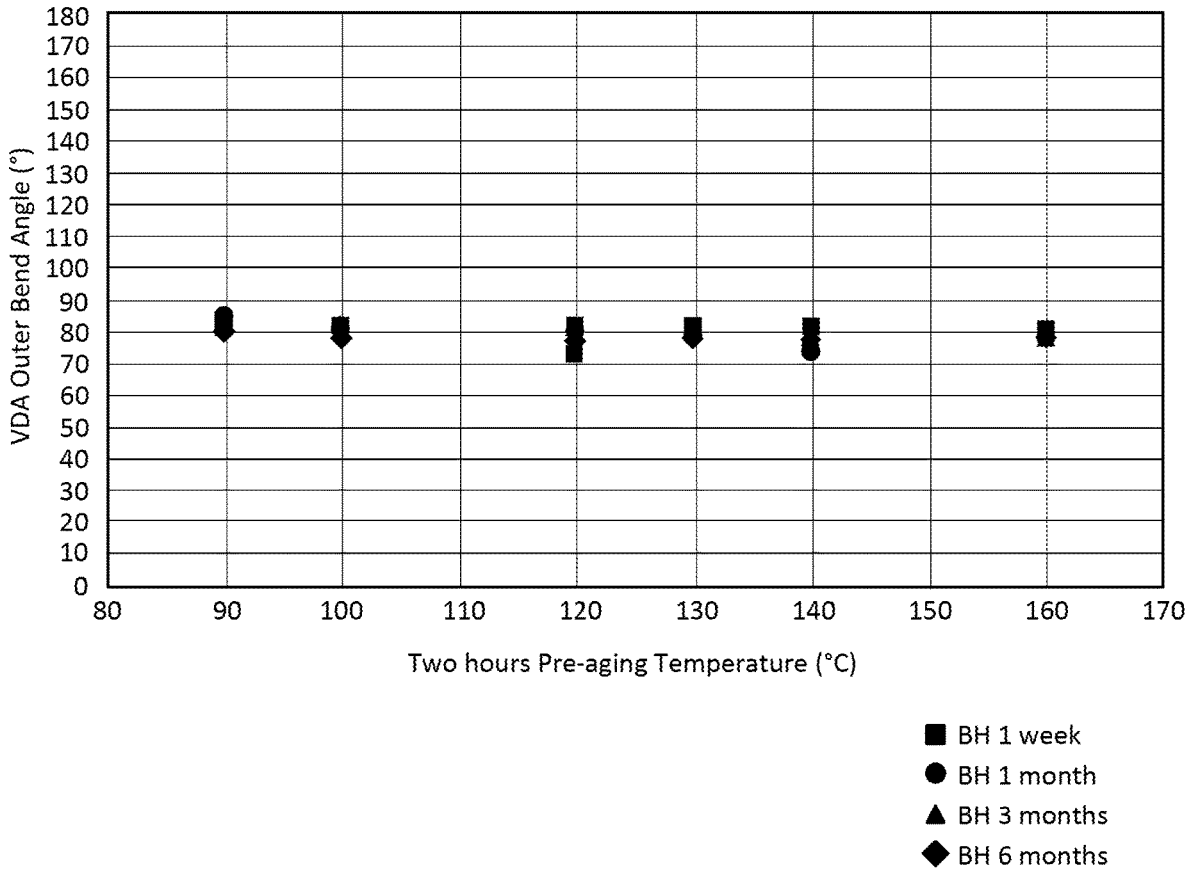
FIG. 16 is a graph showing the outer bending angle normalized to 2.0 mm according to the VDA 238-100 test specification of an exemplary alloy over time in T6 temper subjected to various pre-aging temperatures after solutionizing.
Figure 17:
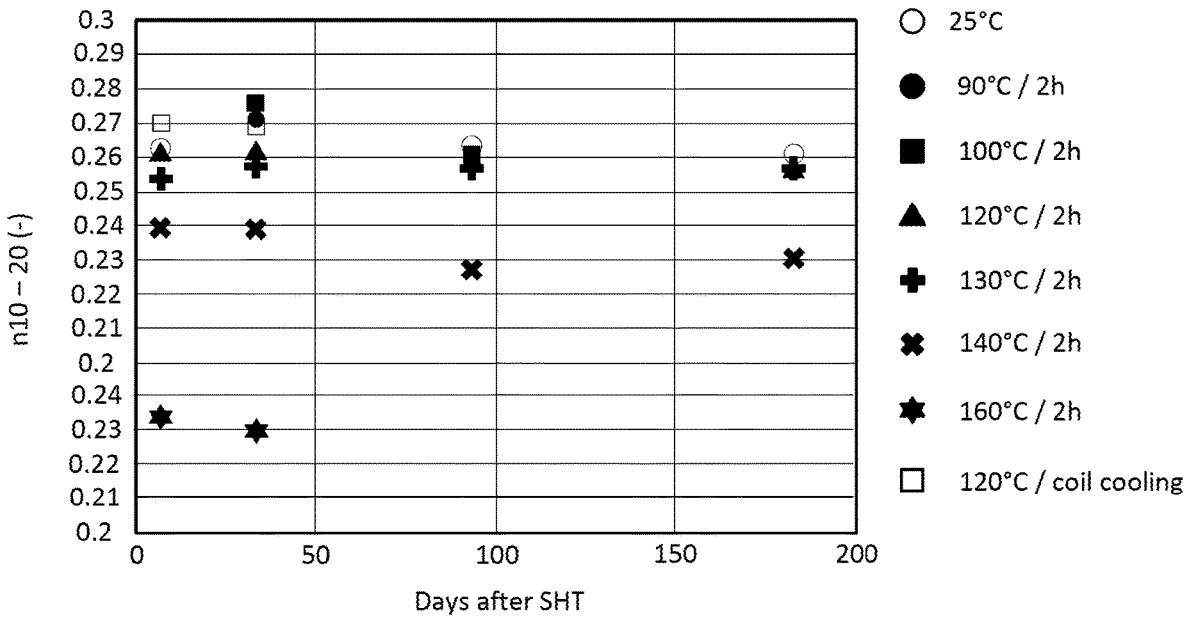
FIG. 17 is a graph showing a comparison of strain hardening exponent (n-value (n10-20)) over time of an exemplary alloy subjected to various pre-aging temperatures after solutionizing.

The exemplary alloy (see Table 4) was stored at room temperature to assess natural aging effects observed for the exemplary alloy pre-aged at various temperatures. FIG. 14 presents the results from one week of natural aging, one month of natural aging, three months of natural aging, and six months of natural aging. Evident in the graph, a greater pre-aging temperature can provide a decreased natural aging effect. FIG. 15 presents the difference of the alloy yield strength (Rp02) measured after one week (7 days) and the alloy yield strength measured after one month (31 days). Higher pre-aging temperatures prevent natural aging effects as evident in the figure. The alloy strength did not increase after one month of natural aging when the pre-aging temperature was greater than 120° C. An optimum pre-aging temperature was determined to be greater than 110° C., where the change in alloy yield strength (Rp02) is less than 2 MPa. Additionally, a higher pre-aging temperature did not deteriorate the bendability of the exemplary alloys in T6 temper (accomplished by artificially aging at 180° C. for 10 hours). FIG. 16 shows no difference in the alloy bendability when subjected to pre-aging over a range of temperatures from 90° C. to 160° C. FIG. 17 presents the n-values plotted over time for various samples subjected to natural aging. Higher n-values are desired for forming difficult metal structures. Very good n-values were demonstrated by alloy samples pre-aged at temperatures less than 140° C. Additionally, when subjected to pre-aging at temperatures ranging from 110° C. to 130° C., the exemplary alloy exhibited no decrease of the n-value for a time period of at least 6 months. The stable n-value indicates stable forming properties. In comparison, when subjected to pre-aging at temperatures less than 110° C., the exemplary alloy exhibited a decrease of the n-value over 6 months. An unstable n-value can indicate stable forming can only be performed at an optimum time before stability of the forming properties can degrade.

Optimum pre-aging was determined by maximizing the paint bake response, stabilizing strength and elongation over time and maximizing the alloy bendability.

Example 6: Comparing an Exemplary Alloy and Comparative Alloy AA6014

Figure 18:
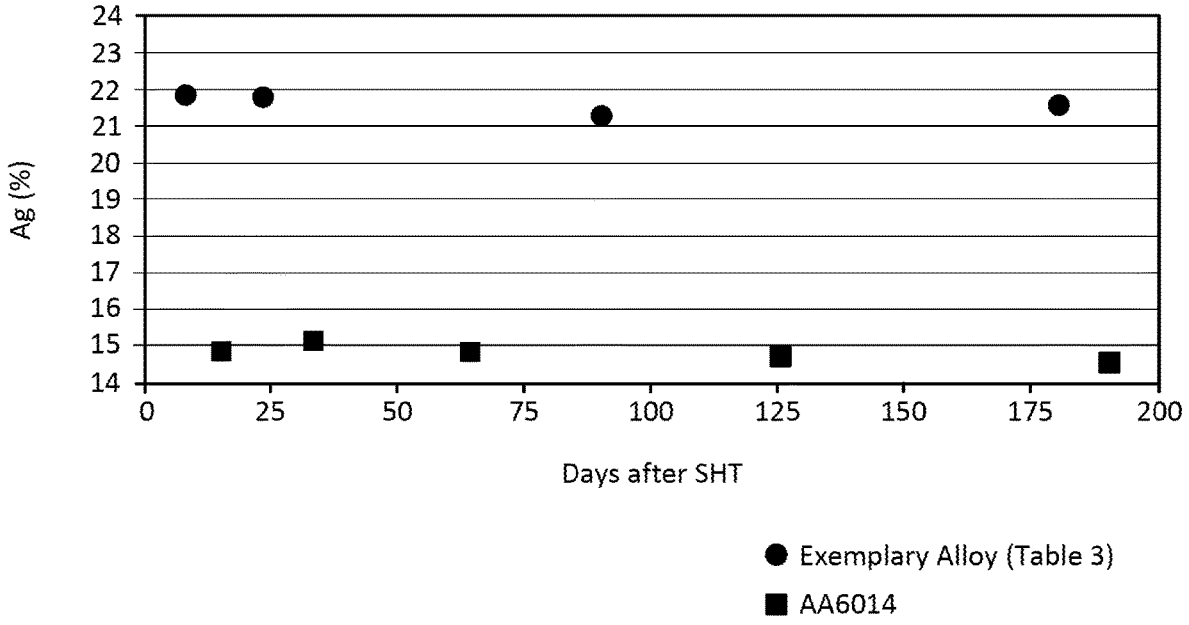
FIG. 18 is a graph showing a comparison of elongation (Ag) over time of an exemplary alloy and a comparative alloy.

An exemplary alloy as described herein (see Table 4) is compared to an AA6014 aluminum alloy. Both alloys were pre-aged after solutionizing at 130° C. upon exit from a continuous heat treatment line. FIG. 18 shows elongation (Ag) measured at different time intervals after solution heat treatment (SHT). Both alloys show very stable elongation over time, and the exemplary alloy demonstrates much higher elongation than the comparative AA6014 alloy. As noted above, the pre-aging process can be composition dependent.

Example 7: Effect of Pre-Aging on Comparative Alloys

Three comparative alloys were pre-aged after laboratory solution heat treatment at various temperatures and stored at room temperature to evaluate the natural aging effect on the comparative alloys. The comparative alloys included a high strength AA6016 aluminum alloy (referred to as "AA6016-HS"), a highly formable AA6016 aluminum alloy (referred to as "AA6016-HF"), and an AA6014 aluminum alloy. The chemical compositions of the comparative alloys are listed in Table 5 below:

TABLE 5

| | Alloy | | |
|---|---|---|---|
| Element | AA6016-HS Weight Percentage (wt. %) | AA6016-HF Weight Percentage (wt. %) | AA6014 Weight Percentage (wt. %) |
| Cu | 0.038 | 0.109 | 0.096 |
| Si | 1.04 | 1.26 | 0.55 |
| Mg | 0.51 | 0.273 | 0.59 |
| Cr | 0.0049 | 0.0078 | 0.0058 |
| Mn | 0.079 | 0.059 | 0.047 |
| Fe | 0.176 | 0.146 | 0.158 |

TABLE 5-continued

| Element | Alloy AA6016-HS Weight Percentage (wt. %) | AA6016-HF Weight Percentage (wt. %) | AA6014 Weight Percentage (wt. %) |
|---|---|---|---|
| Zr | 0.001 | 0.001 | 0.001 |
| Zn | 0.057 | 0.0068 | 0.0085 |
| Ti | 0.0199 | 0.0212 | 0.014 |
| Ni | 0.0043 | 0.0027 | 0.0044 |
| Impurities | | 0.0-0.05 (each)<br>0.0-0.15 (total) | |
| Al | | Remainder | |

Figure 19:
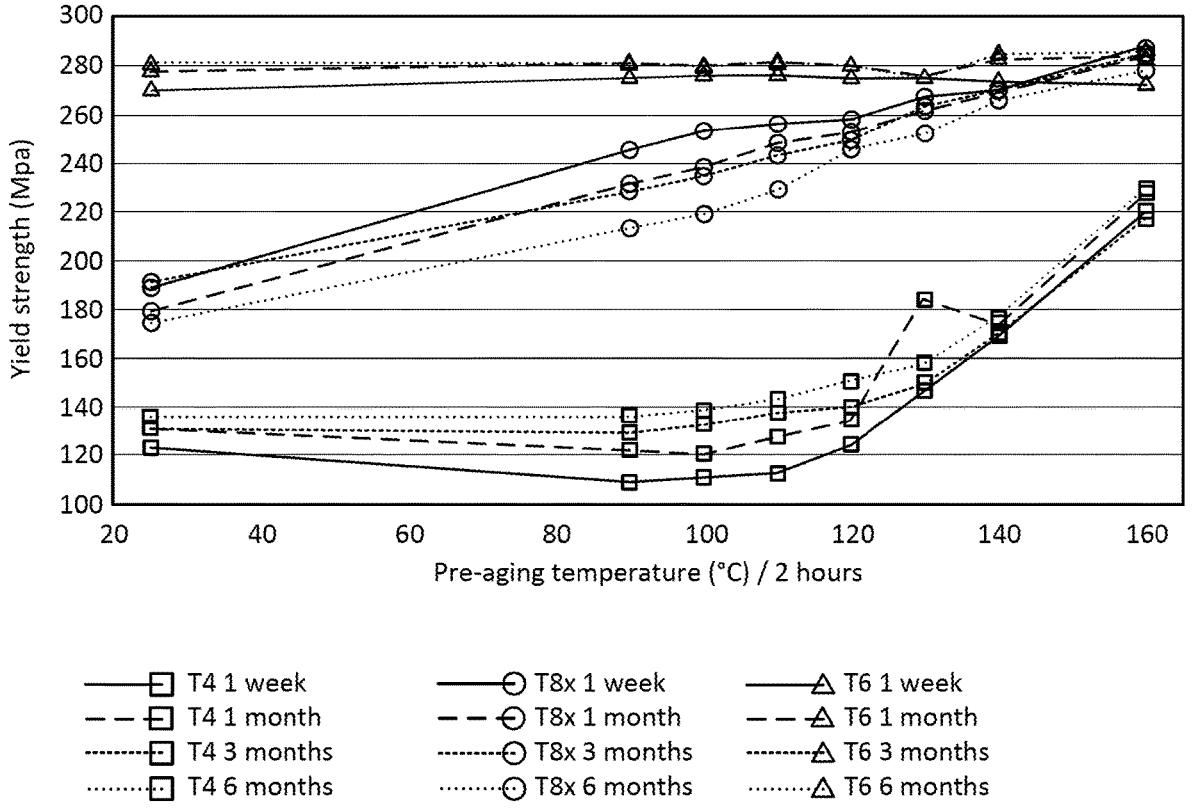
FIG. 19 is a graph showing the yield strength of a comparative alloy after various pre-aging temperatures.

FIG. 19 is a graph showing the effect of pre-aging temperature on comparative alloy AA6016-HS (see Table 5). Pre-aging temperatures were evaluated in a range from about room temperature to 160° C. Pre-aging was performed for 2 hours at temperatures of 25° C., 90° C., 100° C., 110° C., 120° C., 130° C., 140° C., and 160° C. After pre-aging, the comparative alloys were subjected to natural aging (referred to as "T4" in FIG. 19), artificial aging for 10 hours at a temperature of 180° C. (referred to as "T6" in FIG. 19), and paint baking for 20 minutes at a temperature of 185° C. after 2% pre-straining (referred to as "T8x" in FIG. 19). Evident in the graph, natural aging effects decrease when the comparative alloys samples were pre-aged at a temperature of at least 130° C. The comparative alloy subjected to artificial aging for 10 hours at a temperature of 180° C. (T6) and paint baking for 20 minutes at a temperature of 185° C. after 2% pre-straining (T8x) exhibited a maximum yield strength of about 280 MPa.

Figure 20:
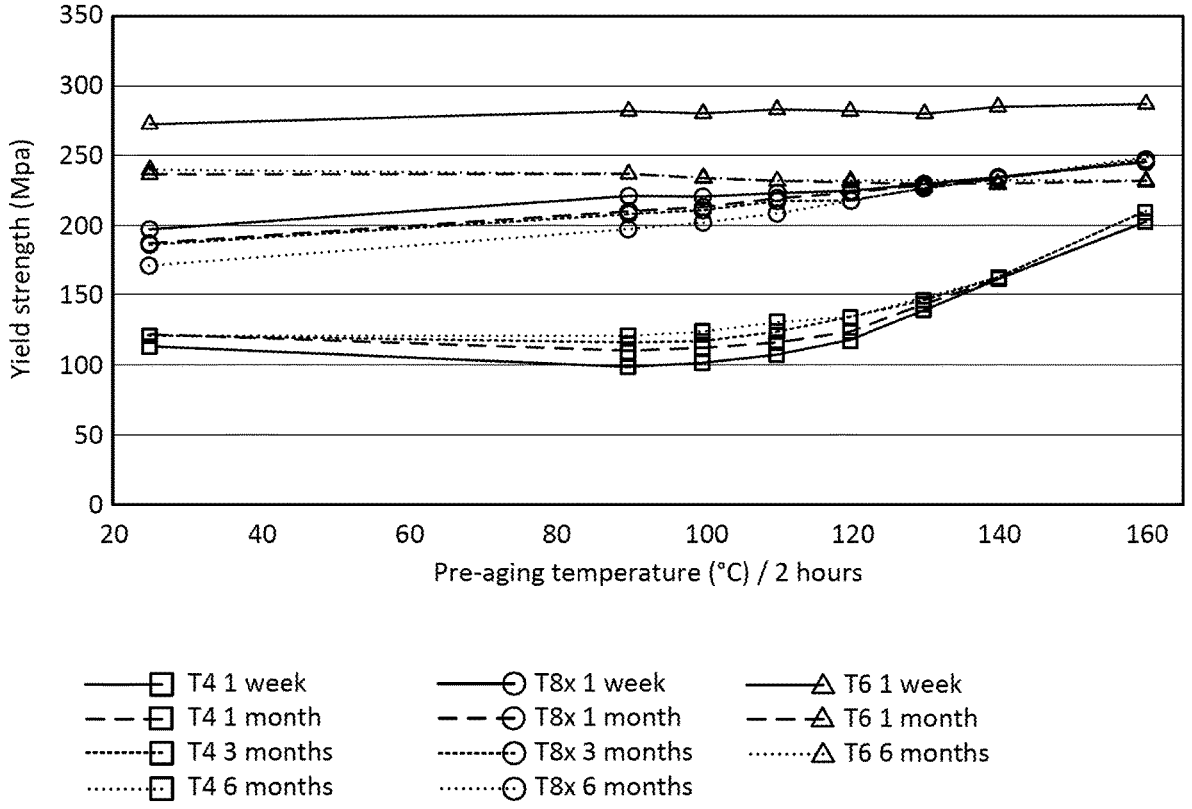
FIG. 20 is a graph showing the yield strength of a comparative alloy after various pre-aging temperatures.

FIG. 20 is a graph showing the effect of pre-aging temperature on comparative alloy AA6016-HF (see Table 5). Pre-aging temperatures were evaluated in a range from about room temperature to 160° C. Pre-aging was performed for 2 hours at temperatures of 25° C., 90° C., 100° C., 110° C., 120° C., 130° C., 140° C., and 160° C. After pre-aging, the comparative alloys were subjected to natural aging (referred to as "T4" in FIG. 20), artificial aging for 10 hours at a temperature of 180° C. (referred to as "T6" in FIG. 20), and paint baking for 20 minutes at a temperature of 185° C. after 2% pre-straining (referred to as "T8x" in FIG. 20). Evident in the graph, natural aging effects decrease when the comparative alloys samples were pre-aged at a temperature of at least 130° C. The comparative alloy subjected to artificial aging for 10 hours at a temperature of 180° C. (T6) exhibited a maximum yield strength of about 250 MPa. The comparative alloy subjected to paint baking for 20 minutes at a temperature of 185° C. after 2% pre-straining (T8x) exhibited a maximum yield strength of about 220 MPa.

Figure 21:
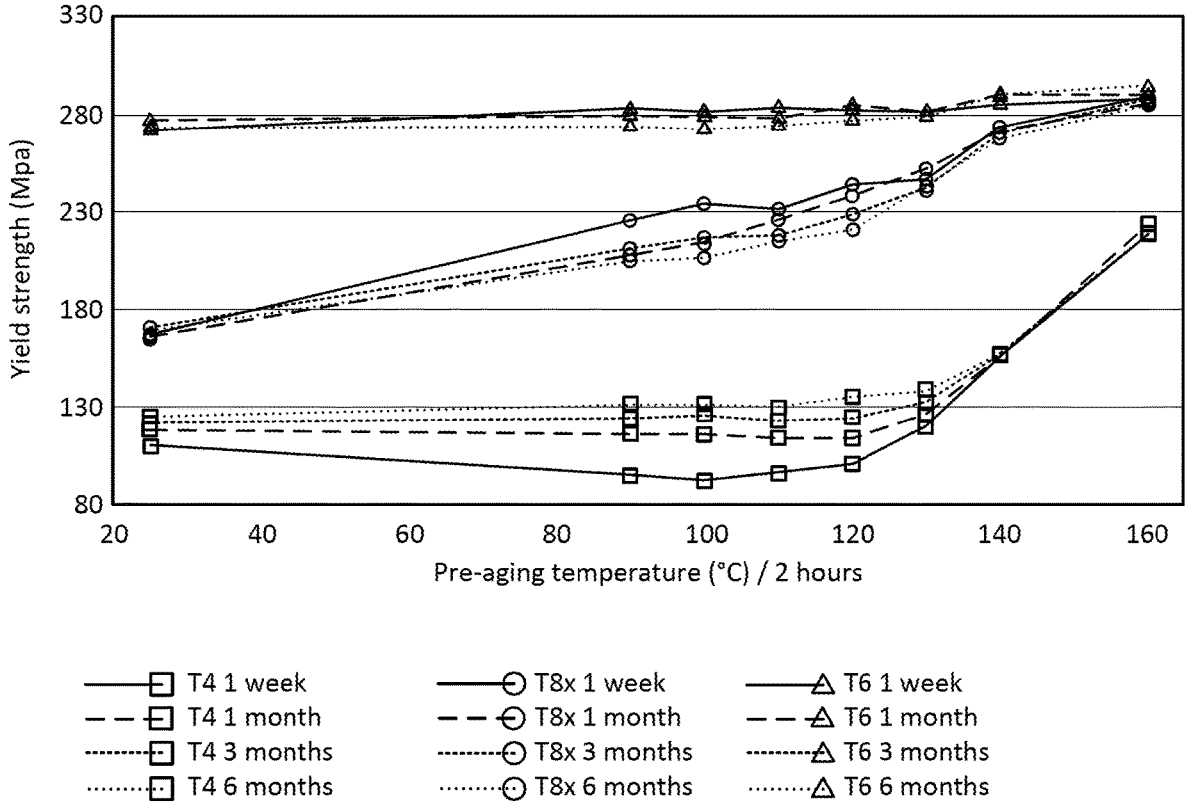
FIG. 21 is a graph showing the yield strength of a comparative alloy after various pre-aging temperatures.

FIG. 21 is a graph showing the effect of pre-aging temperature on comparative alloy AA6014 (see Table 5). Pre-aging temperatures were evaluated in a range from about room temperature to 160° C. Pre-aging was performed for 2 hours at temperatures of 25° C., 90° C., 100° C., 110° C., 120° C., 130° C., 140° C., and 160° C. After pre-aging, the comparative alloys were subjected to natural aging (referred to as "T4" in FIG. 21), artificial aging for 10 hours at a temperature of 180° C. (referred to as "T6" in FIG. 21), and paint baking for 20 minutes at a temperature of 185° C. after 2% pre-straining (referred to as "T8x" in FIG. 21). Evident in the graph, natural aging effects decrease when the comparative alloys samples were pre-aged at a temperature of at least 140° C. The comparative alloy subjected to artificial aging for 10 hours at a temperature of 180° C. (T6) and paint baking for 20 minutes at a temperature of 185° C. after 2% pre-straining (T8x) exhibited a maximum yield strength of about 280 MPa.

Figure 22A:
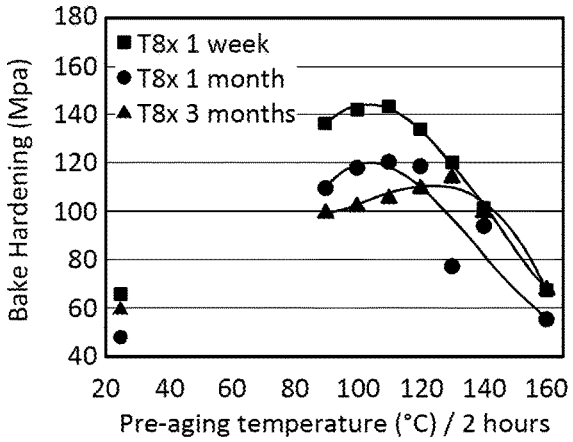
FIG. 22A is a graph showing a comparison of bake hardening (BH) over time of a comparative alloy.
Figure 22B:
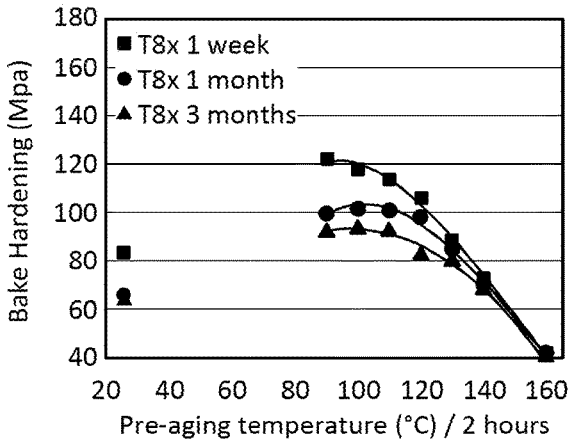
FIG. 22B is a graph showing a comparison of bake hardening (BH) over time of a comparative alloy.
Figure 22C:
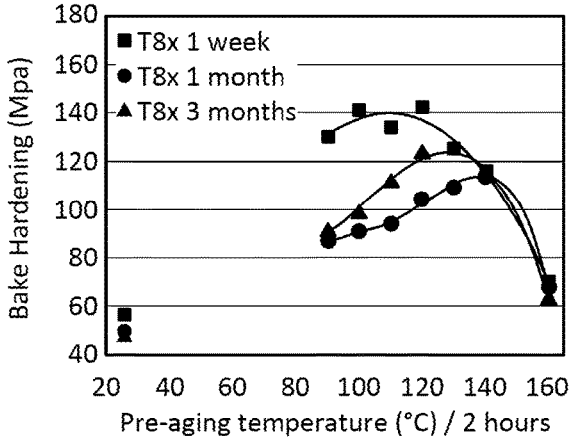
FIG. 22C is a graph showing a comparison of bake hardening (BH) over time of a comparative alloy.
Figure 22D:
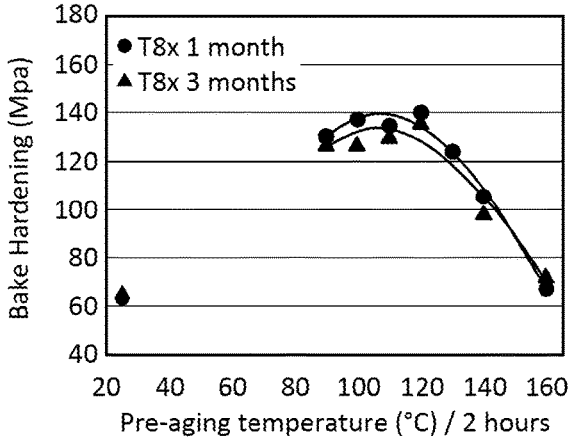
FIG. 22D is a graph showing a comparison of bake hardening (BH) over time of an exemplary alloy.

FIGS. 22A-22D are graphs showing effects of paint baking on the comparative aluminum alloys in Table 5. FIG. 22A shows the effects of paint baking on Alloy AA6016-HS. FIG. 22B shows the effect of paint baking on Alloy AA6016-HF. FIG. 22C shows the effect of paint baking on Alloy AA6014. FIG. 22D shows the effect of paint baking on the exemplary aluminum alloy in Table 3. An increase in strength after paint baking is referred to as "bake hardening," and is calculated by subtracting a measured yield strength of the aluminum alloy not subjected to paint baking from a measured yield strength of the aluminum alloy after paint baking (e.g., paint baking for 20 minutes at a temperature of 185° C. after 2% pre-straining (T8x)). Bake hardening was evaluated for samples stored after paint baking for time periods of 1 week (indicated by solid squares), 1 month (indicated by solid circles), and 3 months (indicated by solid triangles). The exemplary aluminum alloy in Table 3 (FIG. 22D) exhibited a greater bake hardening response than the comparative aluminum alloys listed in Table 5 (FIGS. 22A, 22B, and 22C).

Figure 23:
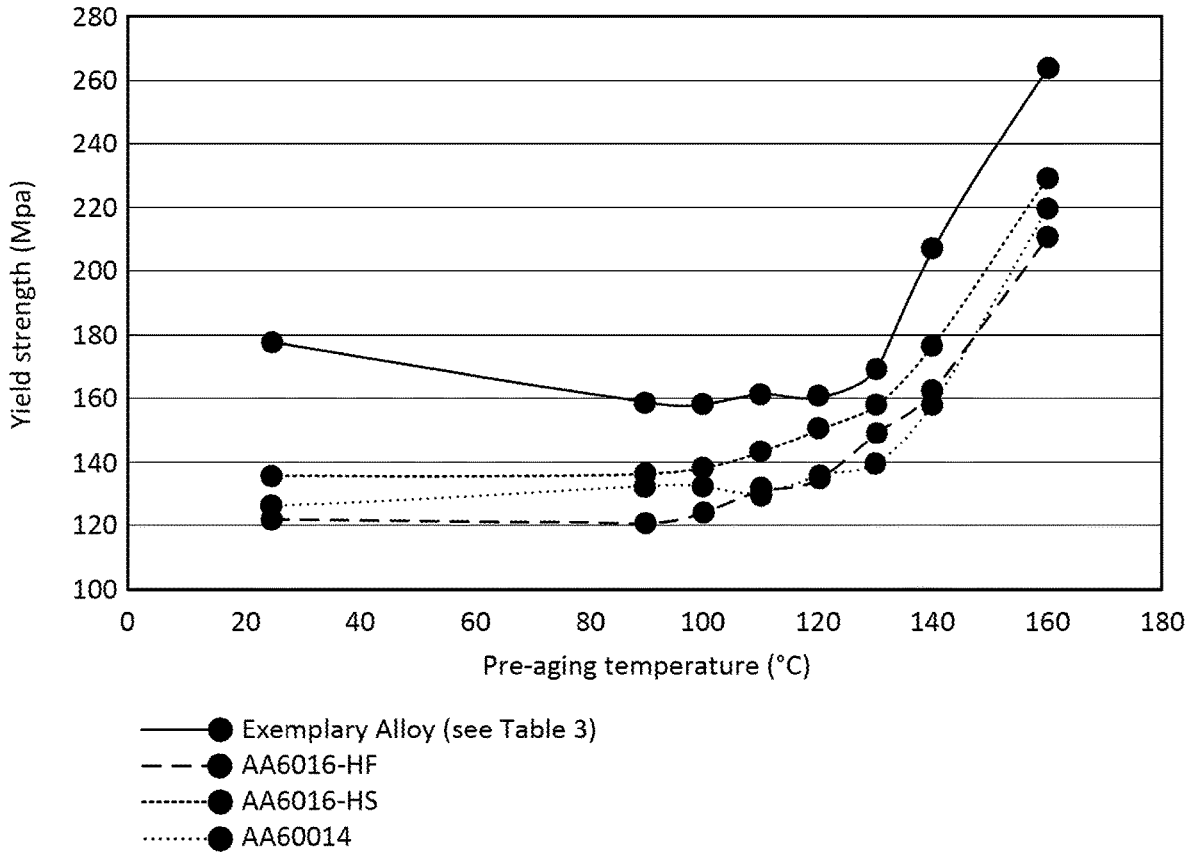
FIG. 23 is a graph showing a comparison of yield strength over time of an exemplary alloy in a T4 temper and comparative alloys in a T4 temper.

FIG. 23 is a graph showing effects of natural aging on yield strength of the comparative aluminum alloys in Table 5 and of the exemplary aluminum alloy in Table 3. Pre-aging temperatures were evaluated in a range from about room temperature to 160° C. Pre-aging was performed for 2 hours at temperatures of 25° C., 90° C., 100° C., 110° C., 120° C., 130° C., 140° C., and 160° C. After pre-aging, all samples were subjected to natural aging for a time period of 6 months. Evident in the graph of FIG. 23, the exemplary aluminum alloy (see Table 3) consistently exhibited the greatest strength.

Figure 24:
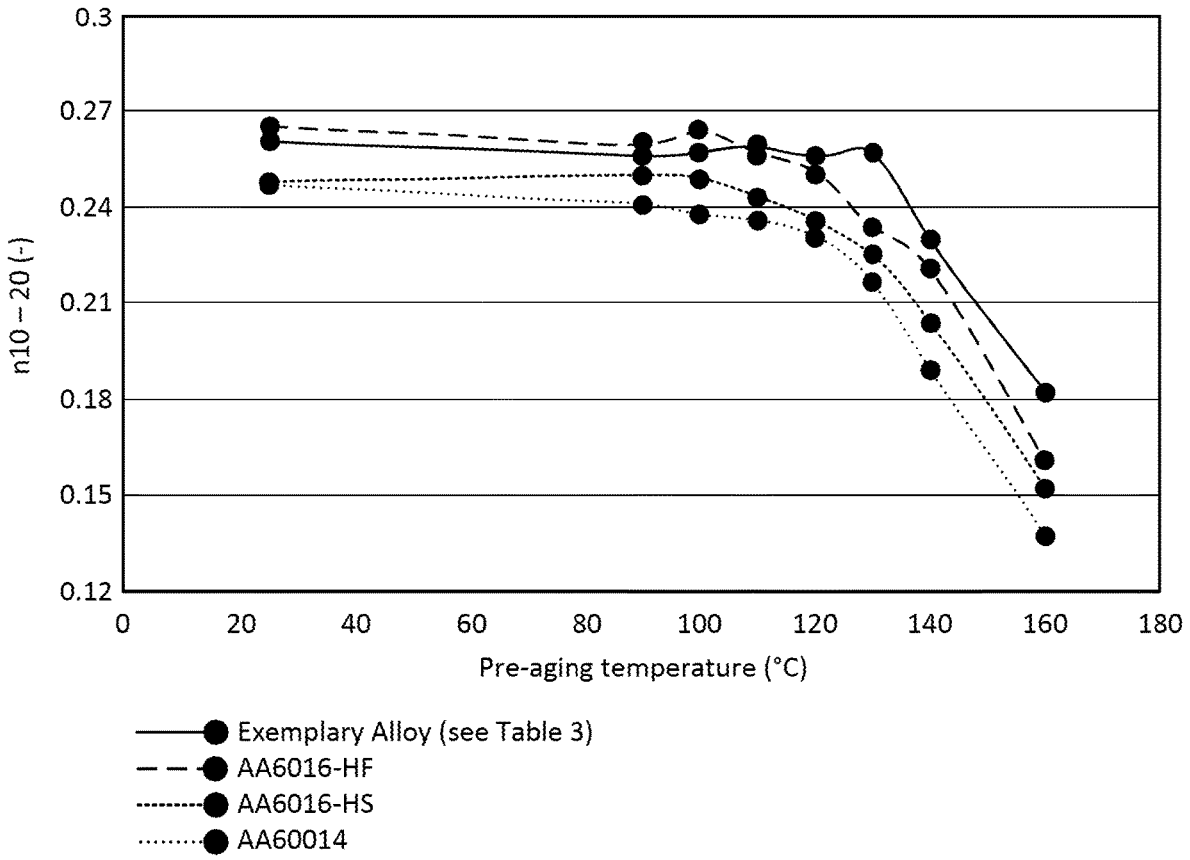
FIG. 24 is a graph showing a comparison of formability over time of an exemplary alloy and comparative alloys.

FIG. 24 is a graph showing effects of natural aging on formability of the comparative aluminum alloys in Table 5 and the exemplary aluminum alloy in Table 3. Pre-aging temperatures were evaluated in a range from about room temperature to 160° C. Pre-aging was performed for 2 hours at temperatures of 25° C., 90° C., 100° C., 110° C., 120° C., 130° C., 140° C., and 160° C. After pre-aging, all samples were subjected to natural aging for a time period of 6 months. Evident in the graph of FIG. 24, the exemplary aluminum alloy (see Table 3) exhibited greater n-values when pre-aged at temperatures of at least 110° C., indicating the exemplary aluminum alloy is more amenable to forming.

Figure 25:
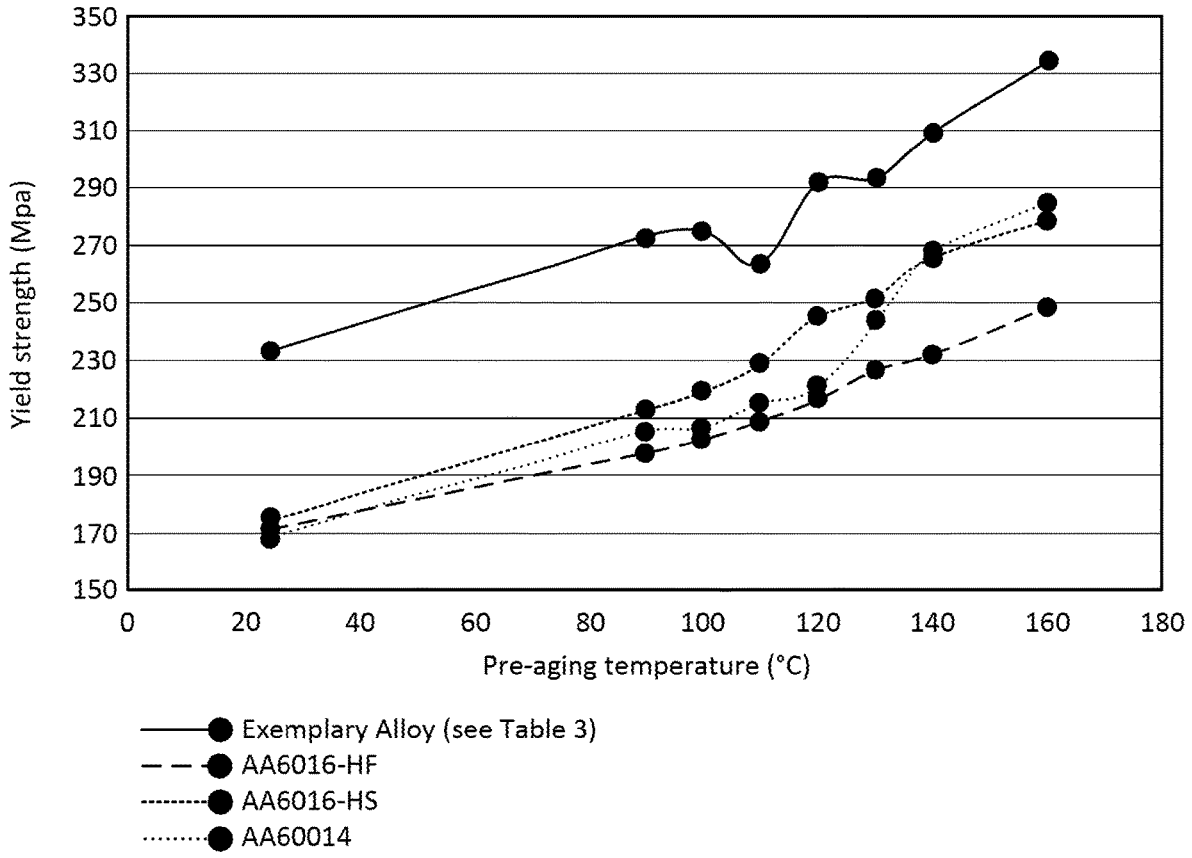
FIG. 25 is a graph showing a comparison of yield strength over time of an exemplary alloy in a T8x temper and comparative alloys in a T8x temper.

FIG. 25 is a graph showing effects of paint baking on yield strength of the comparative aluminum alloys in Table 5 and the exemplary aluminum alloy in Table 3. Pre-aging temperatures were evaluated in a range from about room temperature to 160° C. Pre-aging was performed for 2 hours at temperatures of 25° C., 90° C., 100° C., 110° C., 120° C., 130° C., 140° C., and 160° C. After pre-aging, all samples were subjected to paint baking for 20 minutes at a temperature of 185° C. after 2% pre-straining (T8x) and subsequently stored for a time period of 6 months. Evident in the graph of FIG. 25, the exemplary aluminum alloy (see Table 3) consistently exhibited the greatest strength.

The exemplary alloy according to Table 3 exhibited very stable forming properties for at least 6 months after solution heat treating, very high n-values after 6 months, and a very high paint bake response for the exemplary alloy in the T8x temper (e.g., after paint baking for 20 minutes at a temperature of 185° C. after 2% pre-straining). Such characteristics indicate a high-strength aluminum alloy amenable to complex forming procedures to provide, for example, automotive B-pillars, structural tunnels, or any suitable complex aluminum alloy article.

Figure 26A:
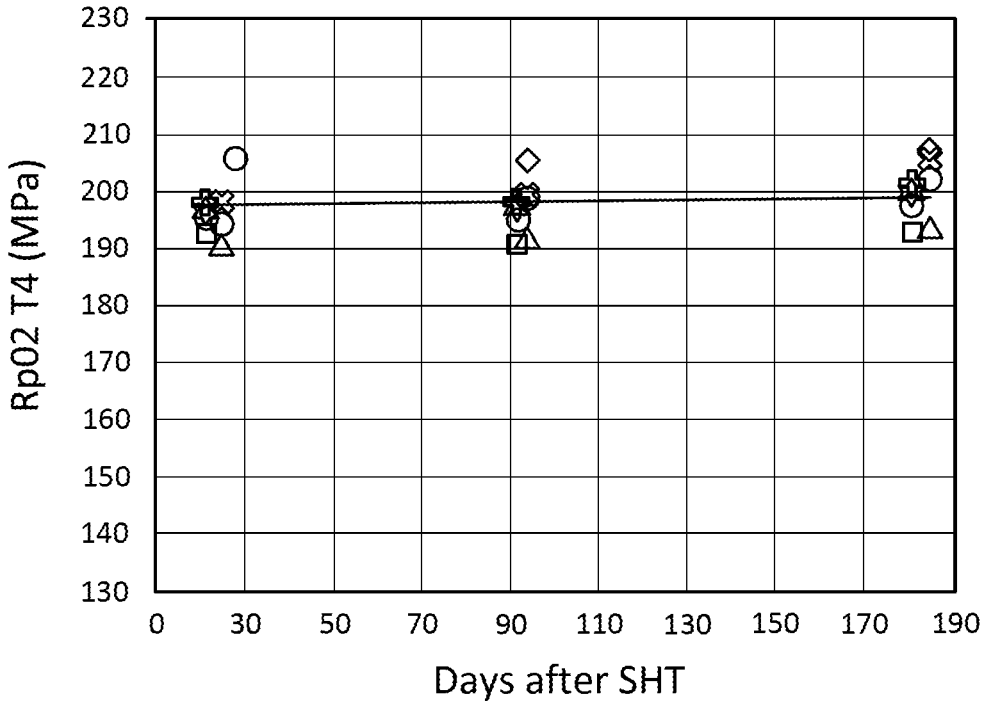
FIG. 26A is a graph showing yield strength after natural aging of an exemplary alloy.

FIG. 26A is a graph showing the effect of natural aging on 6 aluminum alloy samples prepared from the exemplary alloy of Table 4. The aluminum alloy samples were subjected to pre-aging at a temperature of 130° C. for 2 hours. The yield strength of each sample was evaluated after about 10 to about 20 days of natural aging, after about 90 to about 100 days of natural aging, and after about 180 to about 190 days of natural aging. Evident in the graph of FIG. 26A, any effect of natural aging was insignificant.

Figure 26B:
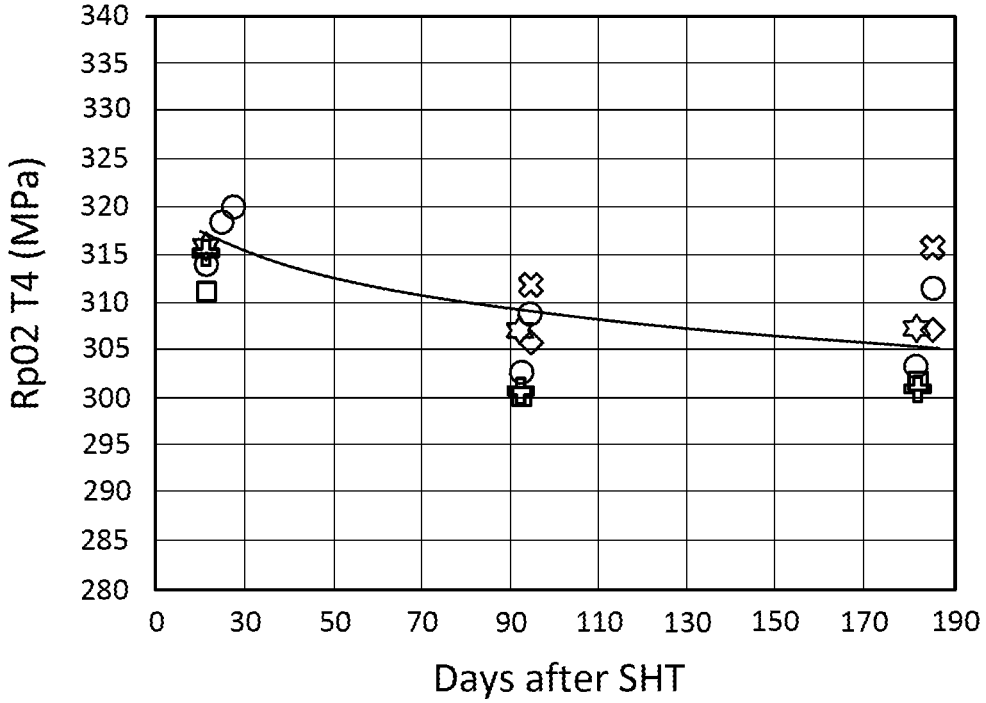
FIG. 26B is a graph showing yield strength after paint baking and natural aging of an exemplary alloy.

FIG. 26B is a graph showing the effect of natural aging on 6 aluminum alloy samples taken from the exemplary alloy as in the example of Table 4. The aluminum alloy samples were subjected to pre-aging at a temperature of 130° C. for 2 hours and subsequently subjected to paint baking for 20 minutes at a temperature of 185° C. after 2% pre-straining (T8x). The yield strength of each sample was evaluated after about 10 to about 20 days of natural aging, after about 90 to about 100 days of natural aging, and after about 180 to about 190 days of natural aging. Evident in the graph of FIG. 26B, any effect of natural aging is insignificant and high strength (e.g., greater than about 300 MPa) is maintained after paint baking and at least 6 months of storing.

Example 8: Effect of Pre-Straining and Post-Forming Heat Treatment

Figure 27:
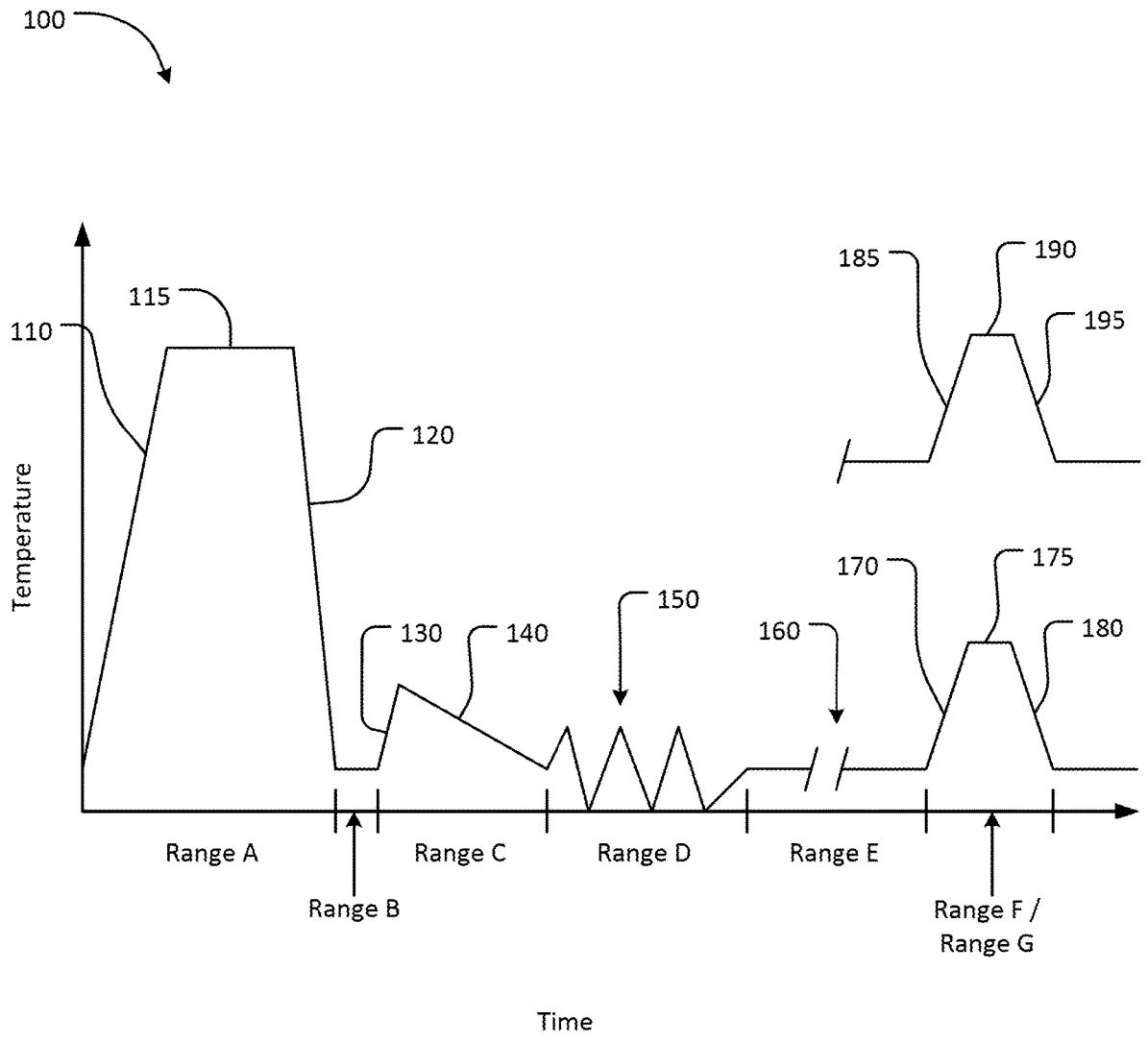
FIG. 27 is a schematic diagram of a process as described herein.

An exemplary thermal process 100 is presented in FIG. 27. A heat treatable alloy is subjected to a solutionizing step to evenly distribute alloying elements throughout the aluminum matrix. The solutionizing step can include heating 110 the alloy to above a solutionizing temperature 115 sufficient to soften the aluminum without melting and then maintaining the alloy above the solutionizing temperature 115. The solutionizing step can be performed for a period of time of about 1 minute to about 5 minutes (Range A). Solutionizing can allow the alloying elements to diffuse throughout and distribute evenly within the alloy. Once solutionized, the aluminum alloy is rapidly cooled (i.e., quenched) 120 to freeze the alloying elements in place and prevent the alloying elements from agglomerating and precipitating out of the aluminum matrix.

The solutionized and quenched exemplary alloy is then subjected to an aging procedure after the quenching step. In some examples the aging step is performed for a period of about 1 minute to about 20 minutes (Range B) after the quenching step. The aging procedure can include a pre-aging step, which includes heating the solutionized and quenched aluminum alloy 130 and cooling 140 for a time period that can be greater than 24 hours (Range C).

In some cases, an exemplary pre-straining step 150 can be performed in which a uniaxial tension is applied to the alloy providing a plastic elongation of up to 10%.

Range E (see FIG. 27) can include natural aging 160, coating, forming, or any combination thereof. In some non-limiting examples, natural aging 160 can occur during aluminum alloy storage. In some examples, the aluminum alloy can be coated. In some further examples, the aluminum alloy can be formed into an aluminum alloy part. In some still further examples, the aluminum alloy can be thermally treated (Range F/Range G) after coating or forming. In some cases, the thermal treatment performed after coating, forming, or any combination thereof, can further age harden the aluminum alloy. In some examples, as part of the coating procedure, the coated samples can be heated 170 to about 180° C., maintained at 180° C. for about 20 minutes 175 and cooled 180 (Range F). As part of the forming procedure, the formed samples can be can be heated 185 to about 195° C., maintained at 195° C. for about 30 minutes 175 and cooled 195 (Range G).

Example 9: Effect of Pre-Straining and Post-Forming Heat Treatment

The effects of pre-straining and post-forming on an exemplary aluminum alloy having a composition as described herein were determined. The exemplary alloy used for the tests has the following composition: 0.69% Si, 0.79% Cu, 0.9% Mg, 0.22% Fe, 0.03% Mn, 0.023% Ti, 0.25% Cr, 0.063% Zn, 0.0046% Ni, and 0.016% V, with the remainder Al.

Figure 28:
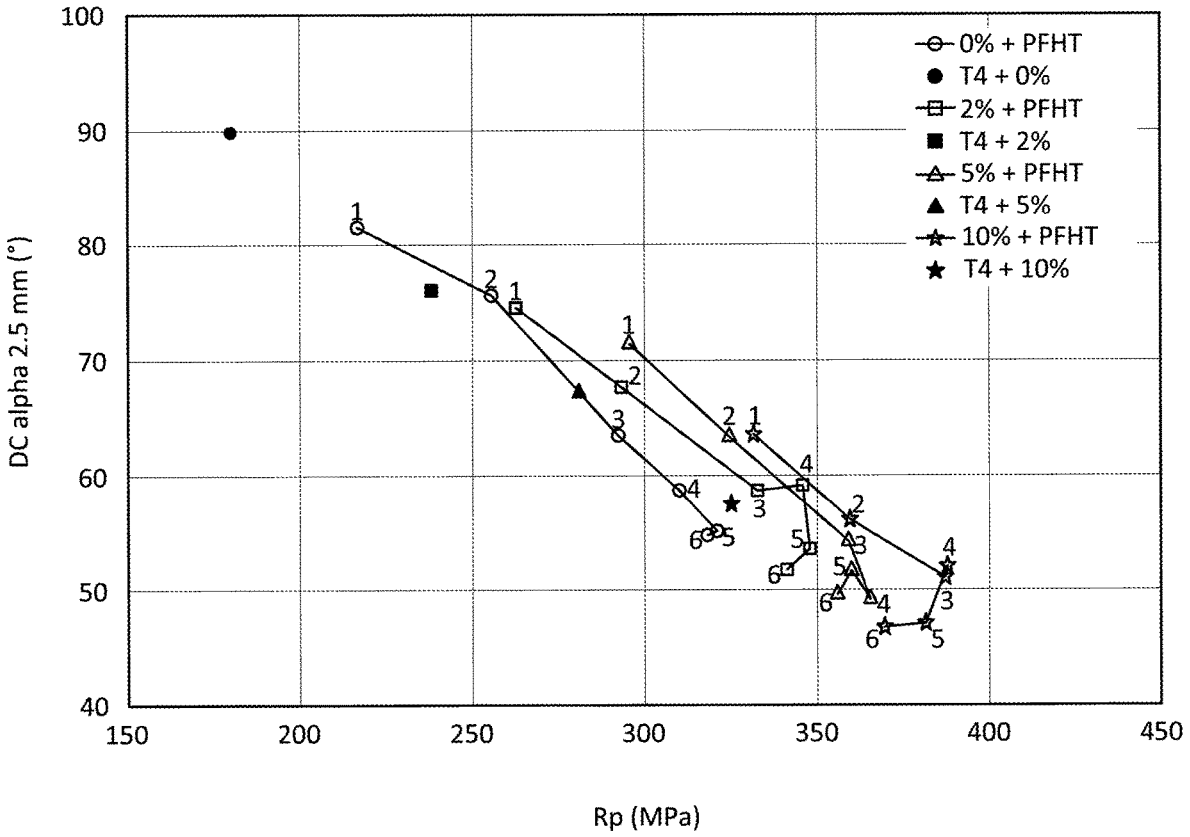
FIG. 28 is a graph showing the bend angles and strength for aluminum alloys subjected to various pre-straining procedures.
Figure 29:
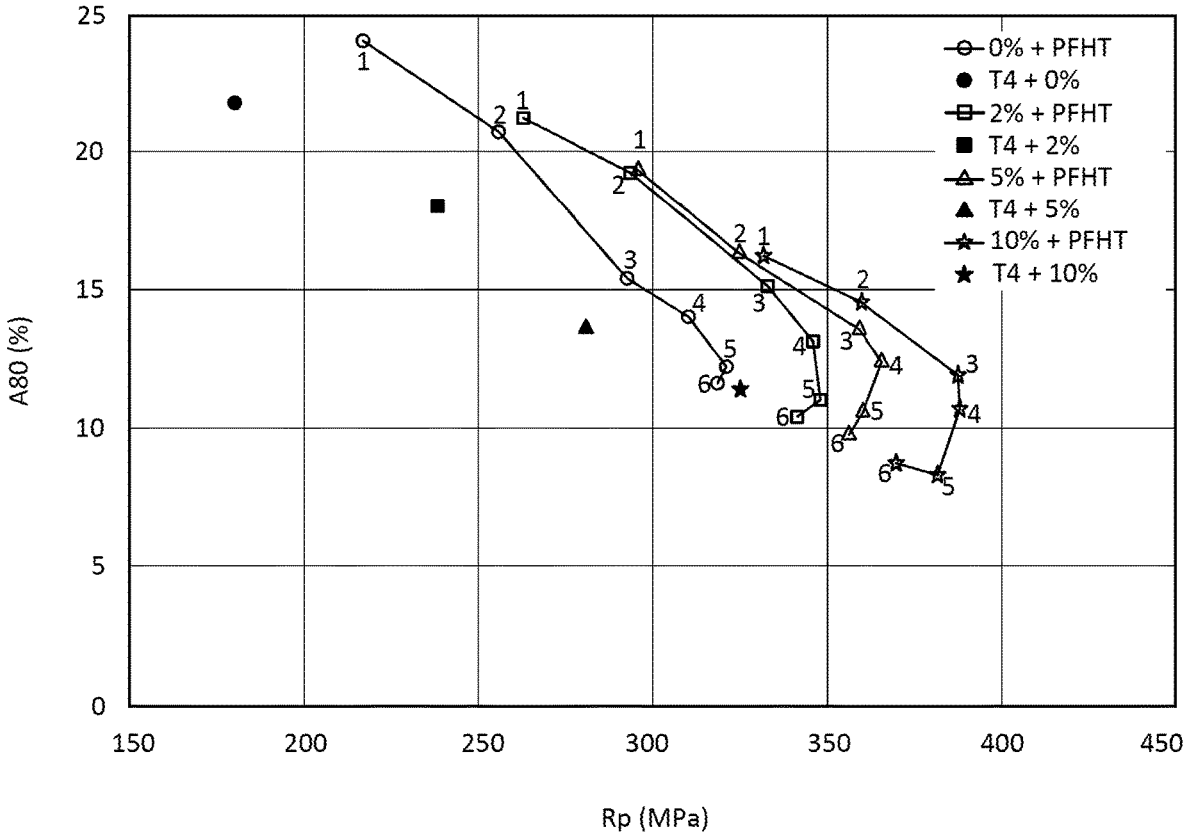
FIG. 29 is a graph showing the percent elongation and strength for aluminum alloys subjected to various pre-straining procedures.

FIGS. 28 and 29 show the changes in deformability and yield strength after various pre-straining and PFHT performed at various temperatures for 30 minutes. Aluminum alloy samples subjected to pre-straining without PFHT are indicated by solid symbols. Aluminum alloy samples subjected to pre-straining with PFHT are indicated by open symbols and connecting lines. PFHT temperature are indicated numerically as provided in Table 6.

TABLE 6

| Indicator | Temperature (° C.) |
|---|---|
| 1 | 160 |
| 2 | 180 |
| 3 | 195 |
| 4 | 205 |
| 5 | 215 |
| 6 | 225 |

FIG. 28 shows an increase in yield strength (referred to as "Rp") with increasing pre-straining. FIG. 28 also shows a decrease in bend angle (referred to as "DC alpha 2.5 mm") with increasing pre-straining. Surprisingly, applying a PFHT step provided increased strength with increased pre-straining and a reduced effect on deformability.

FIG. 29 shows an increase in yield strength (referred to as "Rp") with increasing pre-straining. FIG. 29 also shows a decrease in elongation (referred to as "A80") with increasing pre-straining. Applying a PFHT step provided increased strength with increased pre-straining and a reduced effect on deformability. Combining pre-straining and PFHT exhibited a partial restoration of deformability.

Figure 30:
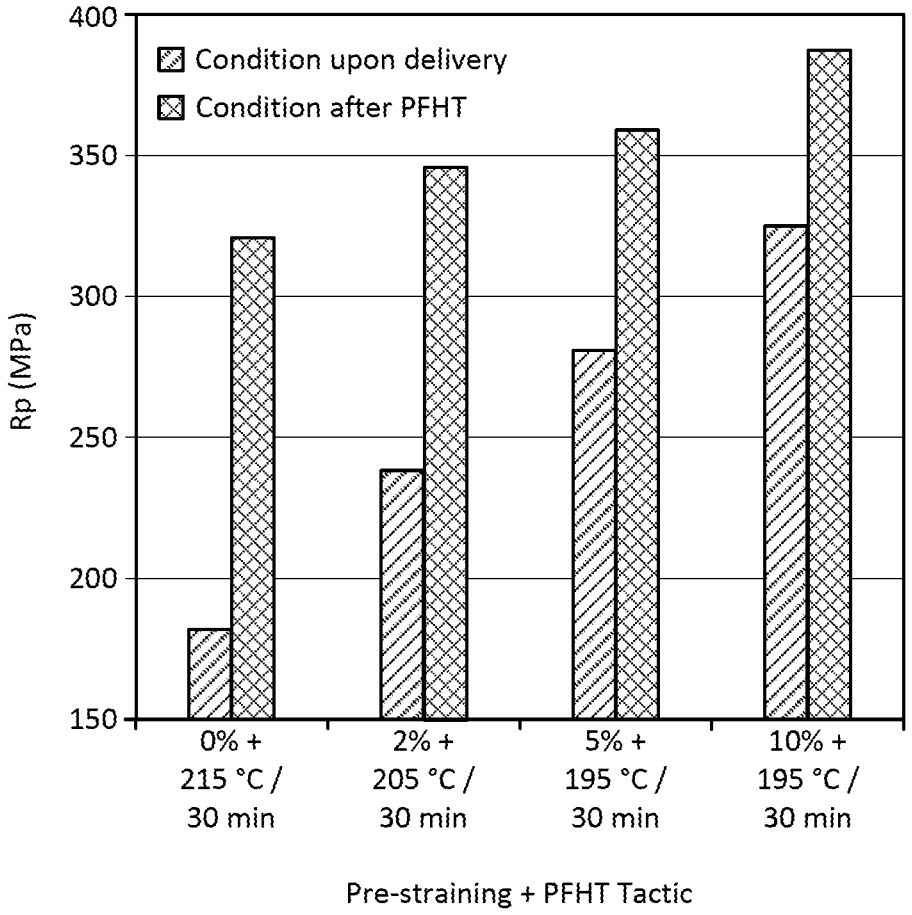
FIG. 30 is a graph showing the yield strengths of aluminum alloys subjected to various pre-straining procedures as described herein upon delivery to a customer and after post-forming heat treatment (PFHT).
Figure 31:
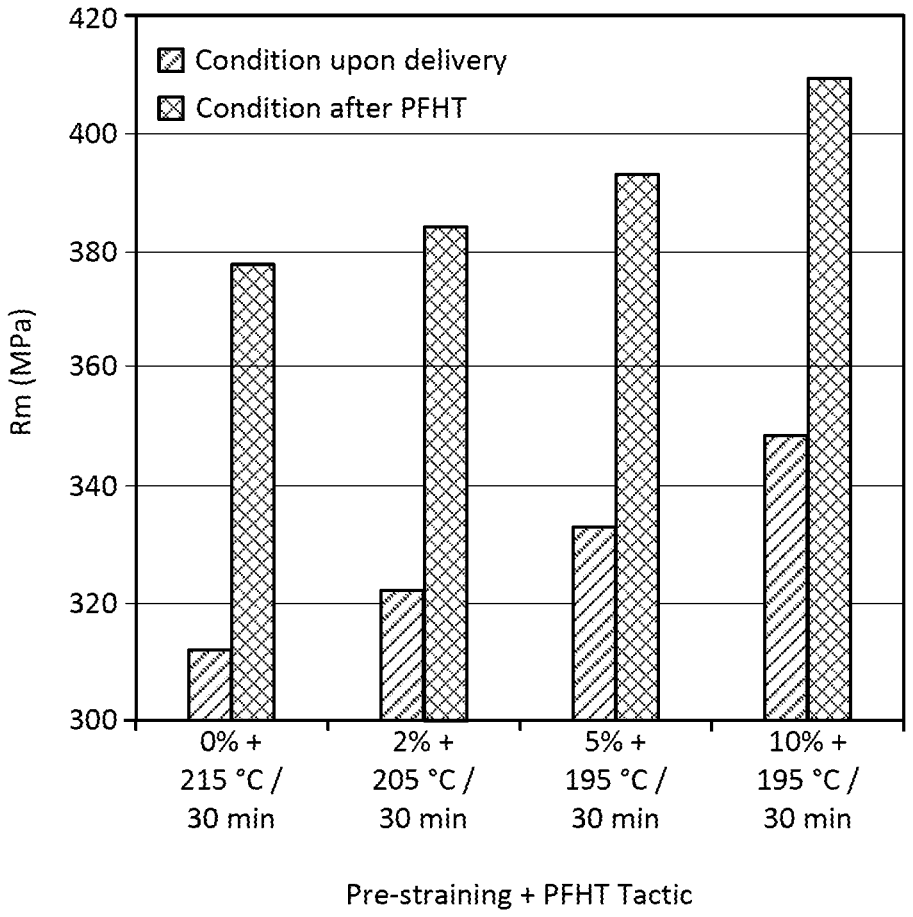
FIG. 31 is a graph showing the tensile strengths of aluminum alloys subjected to various pre-straining procedures as described herein upon delivery to a customer and after post-forming heat treatment (PFHT).

FIGS. 30 and 31 show increases in both yield strength (FIG. 30) and ultimate tensile strength (FIG. 31) after various pre-straining and various PFHT procedures. The PFHT procedures included heating the alloys for 30 minutes at a temperature ranging from 195° C. to 215° C., as indicated in the figures. Yield strengths greater than 300 MPa were achieved after PFHT of aluminum alloys subjected to 0%, 2%, 5%, and 10% pre-straining (see FIG. 30). Ultimate tensile strengths greater than 370 MPa were achieved after PFHT of aluminum alloys subjected to 0%, 2%, 5%, and 10% pre-straining (see FIG. 31). FIGS. 30 and 31 show a significant increase in both yield strength and ultimate tensile strength after PFHT for all pre-strained aluminum alloys.

Figure 32:
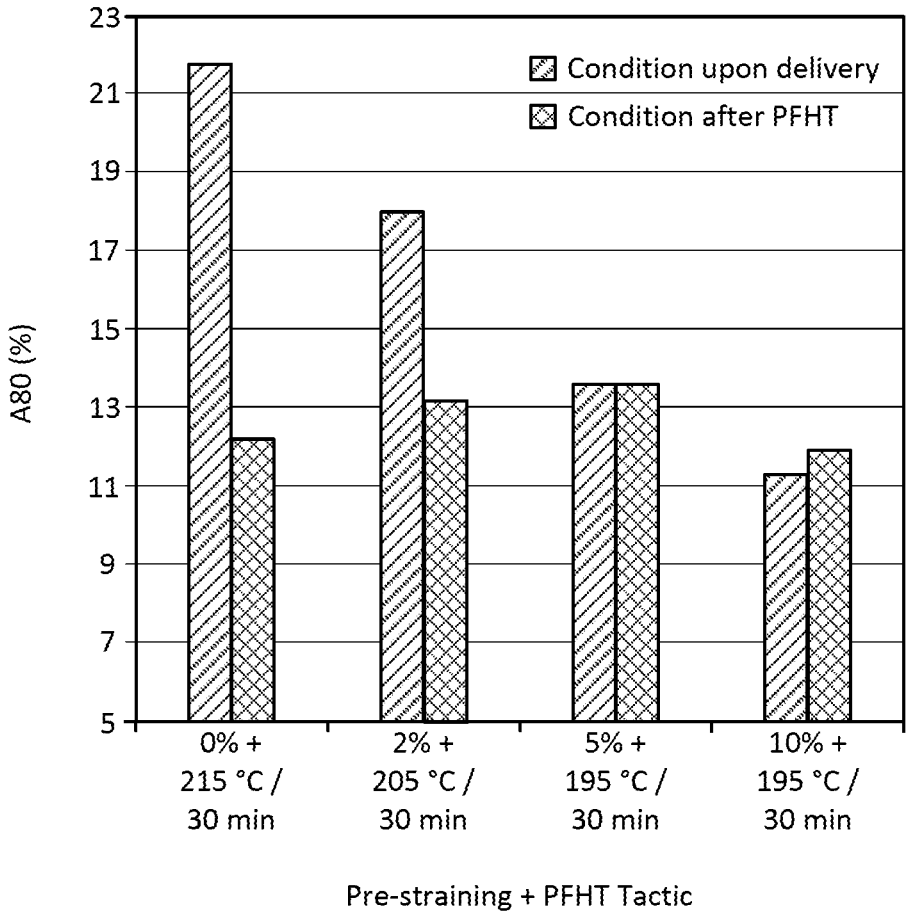
FIG. 32 is a graph showing the percent elongation values of aluminum alloys subjected to various pre-straining procedures as described herein upon delivery to a customer and after post-forming heat treatment (PFHT).
Figure 33:
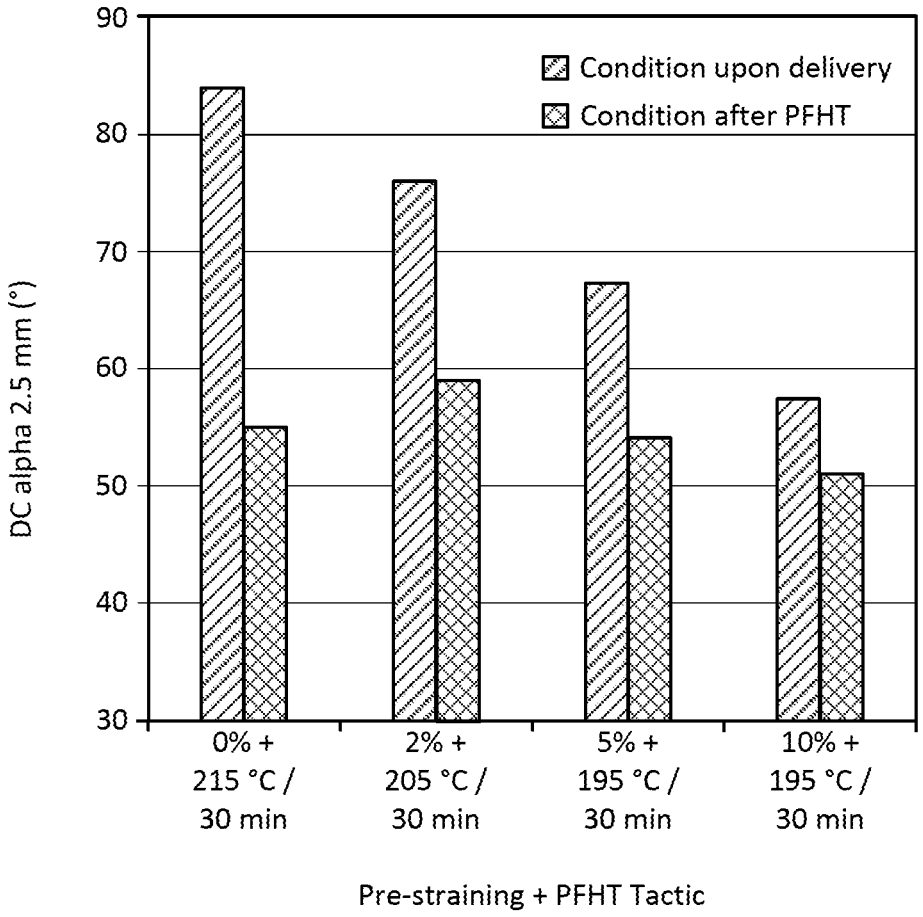
FIG. 33 is a graph showing the bend angles of aluminum alloys subjected to various pre-straining procedures as described herein upon delivery to a customer and after post-forming heat treatment (PFHT).

FIGS. 32 and 33 show decreases in both elongation (FIG. 32) and bend angle (FIG. 33) after various pre-straining and various PFHT procedures. A percent elongation of greater than 11% was achieved after PFHT of aluminum alloys subjected to 0%, 2%, 5%, and 10% pre-straining (see FIG.

32). Bend angles greater than 50° were achieved after PFHT of aluminum alloys subjected to 0%, 2%, 5%, and 10% pre-straining (see FIG. 33). FIGS. 32 and 33 show that there was no significant degradation of deformability in the pre-strained and post-forming heat treated aluminum alloys. Aluminum alloys pre-strained and not subjected to the PFHT, however, do show greater deformability. Surprisingly, all pre-strained aluminum alloys exhibited similar elongation (see FIG. 32) and bendability (see FIG. 33) after PFHT.

Figure 34:
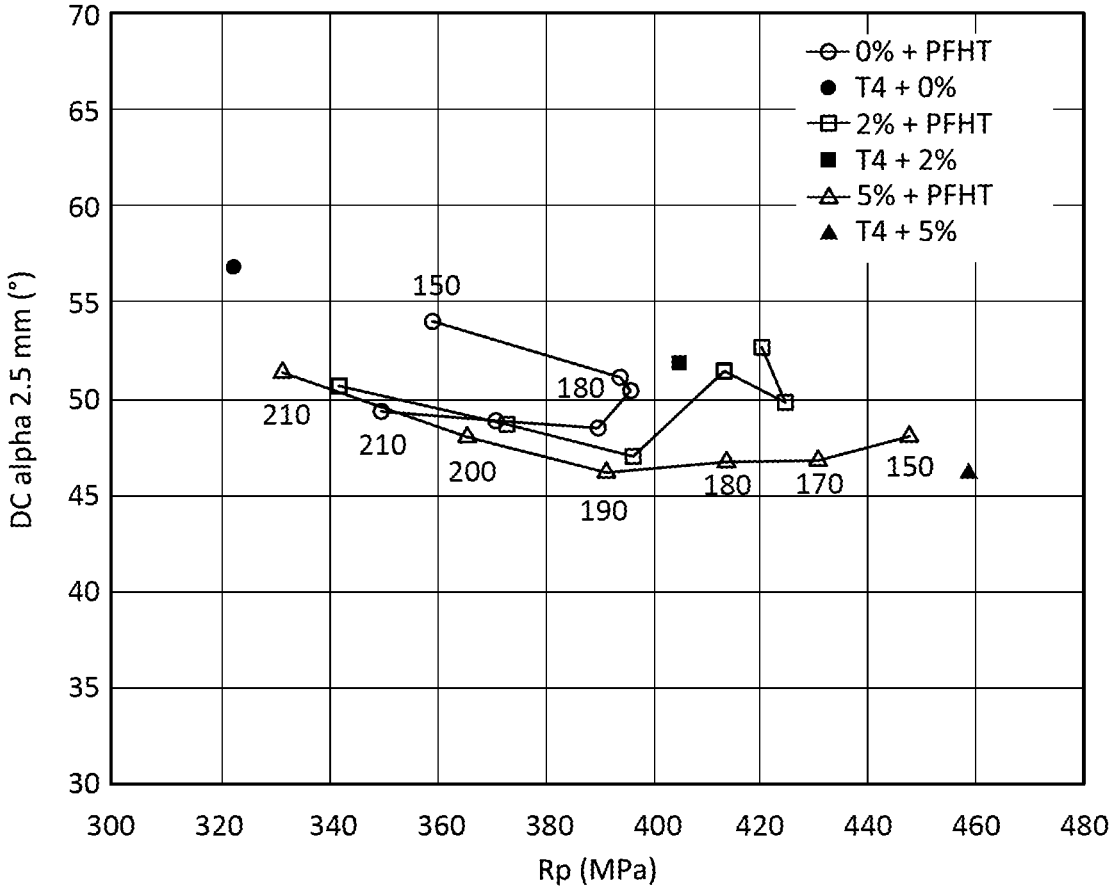
FIG. 34 is a graph showing the bend angles and strength for aluminum alloys subjected to various pre-straining procedures.
Figure 35:
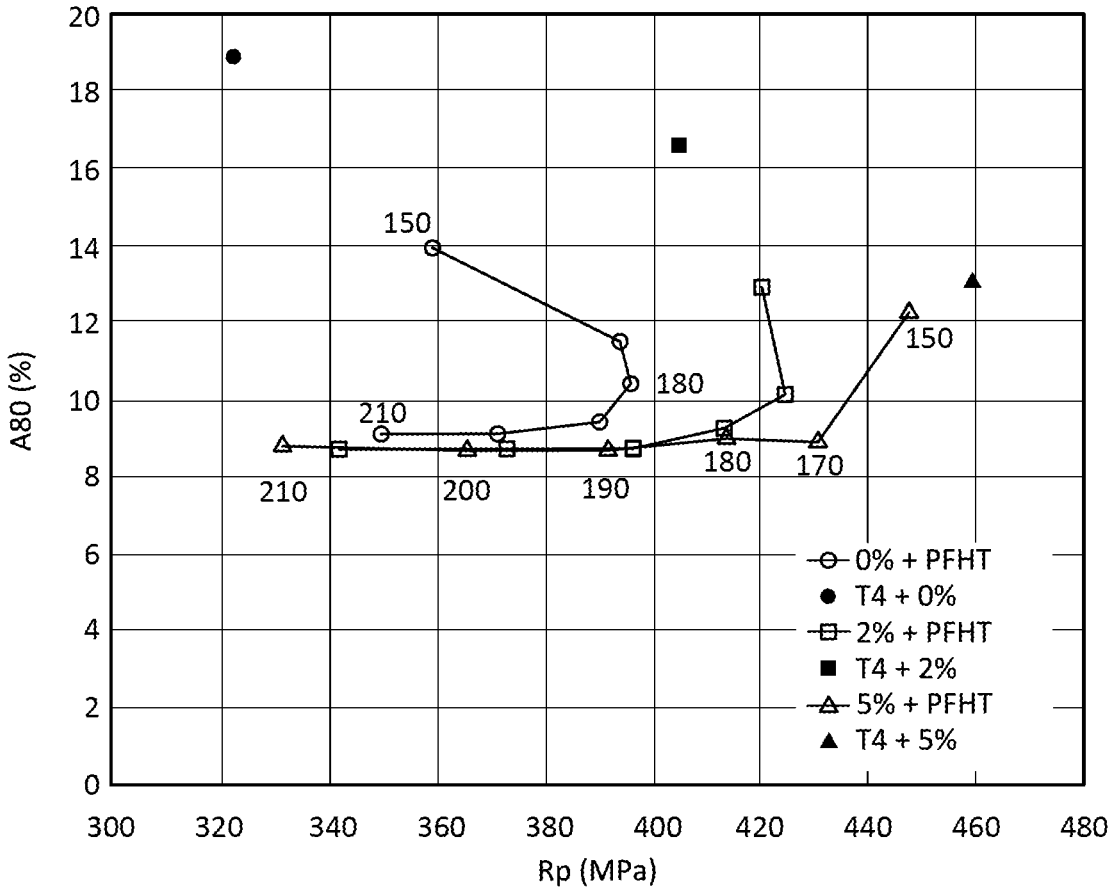
FIG. 35 is a graph showing the percent elongation and strength for aluminum alloys subjected to various pre-straining procedures.

FIGS. 34 and 35 show the changes in deformability and yield strength after various pre-straining and PFHT performed at various temperatures for 30 minutes. Aluminum alloy samples subjected to pre-straining without PFHT are indicated by solid symbols. Aluminum alloy AA7075 samples subjected to pre-straining with PFHT are indicated by open symbols and connecting lines. FIG. 34 shows an increase in yield strength (referred to as "Rp") with increasing pre-straining. FIG. 34 also shows a decrease in bend angle (referred to as "DC alpha 2 mm") with increasing pre-straining. Applying a 2% pre-strain and a PFHT step provided increased strength insignificant effect on deformability, suggesting good crashability. Applying a 5% pre-strain and a PFHT softened the alloy and adversely affecting formability and crashability. FIG. 35 shows an increase in yield strength (referred to as "Rp") with increasing pre-straining. FIG. 35 also shows a decrease in elongation (referred to as "A80") with increasing pre-straining. Applying a PFHT step provided increased strength with increased pre-straining and an adverse effect on deformability. Combining pre-straining and PFHT exhibited a partial restoration of deformability.

Figure 36:
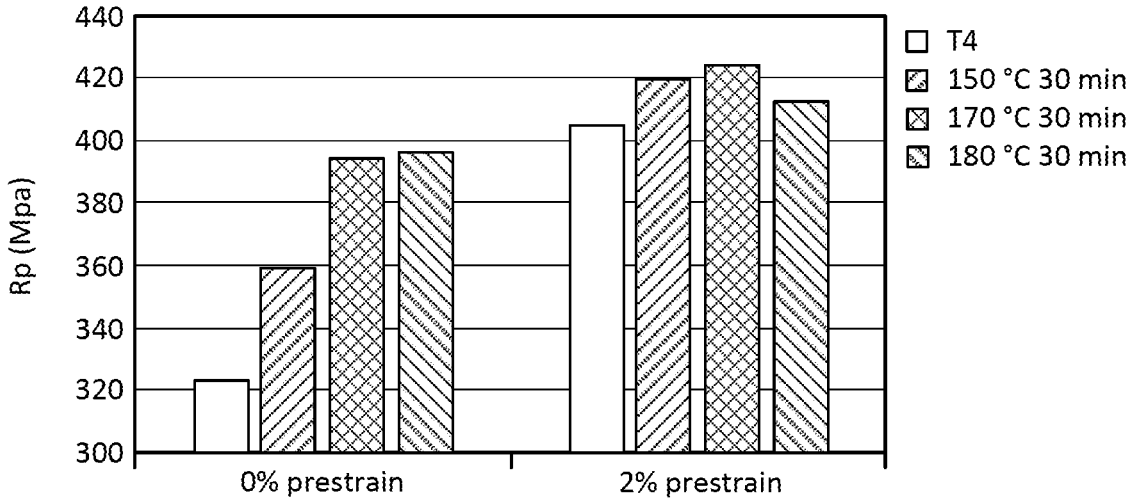
FIG. 36 is a graph showing the yield strengths of aluminum alloys subjected to a pre-straining procedure as described herein upon delivery to a customer and after various paint baking heat treatments.
Figure 37:
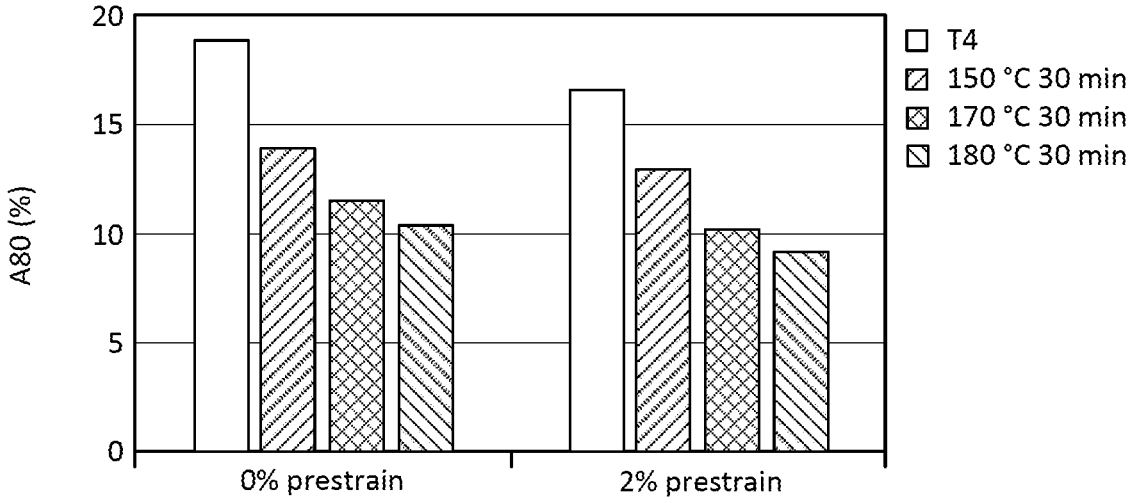
FIG. 37 is a graph showing the percent elongation values of aluminum alloys subjected to a pre-straining procedure as described herein upon delivery to a customer and after various paint baking heat treatments.

FIGS. 36 and 37 show the effects of a 2% pre-strain on yield strength (FIG. 36) and elongation (FIG. 37) on an AA7075 aluminum alloy in T4 temper after various paint baking procedures. As evident in the example of FIG. 36, the 2% pre-straining procedure increased yield strength in the AA7075 aluminum alloy regardless of subsequent paint baking procedure. As evident in FIG. 37, the 2% pre-straining procedure decreased the formability of the AA7075 aluminum alloy after the paint baking procedure.

All patents, publications and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. A method of producing an aluminum alloy metal product, the method comprising;

casting an aluminum alloy to form a cast aluminum alloy product, wherein the aluminum alloy comprises 0.6-1.1 wt. % Cu, 0.6-1.1 wt. % Si, 0.7-1.2 wt. % Mg, up to 0.25 wt. % Cr, up to 0.35 wt. % Mn, 0.15-0.3 wt. % Fe, up to 0.25 wt. % Zr, up to 1.0 wt. % Zn, up to 0.1 wt. % Ti, up to 0.04 wt. % Ni, and up to about 0.15 wt. % of impurities, and Al;

homogenizing the cast aluminum alloy product;

hot rolling the cast aluminum alloy product to produce a sheet, plate, or shate;

solutionizing the sheet, plate, or shate at a temperature between about 520° C. and about 580° C.;

pre-aging the sheet, plate, or shate;

coiling the sheet, plate, or shate, and aging the sheet, plate, or shate at a temperature of from 180° C. to 225° C., wherein an annealing step is not performed while processing the sheet, plate, or shate.

2. The method of claim 1, wherein the aluminum alloy comprises 0.6-1.1 wt. % Cu, 0.6-1.1 wt. % Si, 0.7-1.2 wt. % Mg, up to 0.25 wt. % Cr, up to 0.35 wt. % Mn, 0.15-0.3 wt. % Fe, up to 0.25 wt. % Zr, up to 0.3 wt. % Zn, up to 0.10 wt. % Ti, up to 0.04 wt. % Ni, and up to 0.15 wt. % of impurities, and Al.

3. The method of claim 1, wherein the aluminum alloy comprises 0.75-0.9 wt. % Cu, 0.65-0.9 wt. % Si, 0.85-1.0 wt. % Mg, 0.05-0.18 wt. % Cr, 0.05-0.18 wt. % Mn, 0.15-0.3 wt. % Fe, up to 0.15 wt. % Zr, up to 0.1 wt. % Zn, 0.01-0.04 wt. % Ti, up to 0.034 wt. % Ni, and up to 0.15 wt. % of impurities, and Al.

4. The method of claim 1, wherein the pre-aging comprises heating the sheet, plate, or shate to a temperature of about 115° C. to about 135° C. after solutionizing.

5. The method of claim 1, wherein the pre-aging comprises heating the sheet, plate, or shate to a temperature of about 120° C. to about 130° C. after solutionizing.

6. The method of claim 1, wherein the aluminum alloy metal product comprises a strain hardening exponent of at least 0.23.

7. The method of claim 1 wherein the aluminum alloy metal product comprises a strength of at least 300 MPa after a 2% pre-strain hardening and thermal treatment of about 185° C. for a time period of about 20 minutes.

8. The method of claim 1, wherein the aluminum alloy metal product comprises a strength of at least 300 MPa.

9. The method of claim 1, further comprising strain hardening and thermal treating.

10. The method of claim 9, wherein the strain hardening comprises about 2% and the thermal treating comprises maintaining the aluminum alloy metal product at a temperature of about 185° C. for a time period of about 20 minutes.

11. The method of claim 1, further comprising a thermal treatment of maintaining the aluminum alloy metal product at a temperature of about 185° C. for a time period of about 20 minutes.

12. The method of claim 1, further comprising quenching the aluminum alloy metal product after the solutionizing step.

13. The method of claim 1, further comprising cold rolling the aluminum alloy metal product.

14. The method of claim 1, further comprising pre-straining the aluminum alloy metal product, wherein the pre-straining comprises applying a tensile strain to the aluminum alloy metal product after solutionizing.

15. The method of claim 1, wherein the aluminum alloy metal product is resistant to natural age hardening.

* * * * *